US009607793B2

(12) United States Patent
Beak et al.

(10) Patent No.: US 9,607,793 B2
(45) Date of Patent: Mar. 28, 2017

(54) SWITCH

(71) Applicants: FUJITSU COMPONENT LIMITED, Tokyo (JP); NTT FACILITIES, INC., Tokyo (JP)

(72) Inventors: SeungSeok Beak, Tokyo (JP); Koichi Kiryu, Nagano (JP); Takashi Yuba, Tokyo (JP); Masatoshi Noritake, Tokyo (JP); Keiichi Hirose, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 0 days.

(21) Appl. No.: 14/430,951

(22) PCT Filed: Oct. 1, 2013

(86) PCT No.: PCT/JP2013/076734

§ 371 (c)(1),
(2) Date: Mar. 25, 2015

(87) PCT Pub. No.: WO2014/054654

PCT Pub. Date: Apr. 10, 2014

(65) Prior Publication Data

US 2015/0287558 A1 Oct. 8, 2015

(30) Foreign Application Priority Data

Oct. 4, 2012 (JP) ..... 2012-222552

(51) Int. Cl.
*H01H 9/28* (2006.01)
*H01H 23/12* (2006.01)
(Continued)

(52) U.S. Cl.
CPC ..... *H01H 23/12* (2013.01); *H01H 3/58* (2013.01); *H01H 23/04* (2013.01); *H01H 23/20* (2013.01);
(Continued)

(58) Field of Classification Search
CPC ..... H01H 9/28; H01H 1/00; H01H 1/12; H01H 1/14; H01H 1/20; H01H 1/2008; H01H 1/2041; H01H 1/22; H01H 3/00; H01H 3/02;H01H 23/00; H01H 23/02; H01H 23/04; H01H 23/12; H01H 23/14; H01H 23/16; H01H 23/162; H01H 23/164; H01H 23/166; H01H 23/20; H01H 23/205; H01H 23/24; H01H 2003/00; H01H 2003/001; H01H 2003/002; H01H 2003/022; H01H 1/24; H01H 1/50; H01H 1/56; H01H 1/58; H01H 3/32; H01H 3/46; H01H 9/22; H01H 9/226; H01H 9/24; H01H 9/26; H01H 2003/02; H01H 2003/32; H01H 2003/46; H01H 2009/20; H01H 2009/305; H01H 2009/307; H01H 2009/343; H01H 2009/348; H01H 2009/36; H01H 2009/365; H01H 2009/367
(Continued)

(56) References Cited

U.S. PATENT DOCUMENTS 4,167,720 A 9/1979 Krasser
5,543,595 A * 8/1996 Mader ..... H01H 71/501 200/401
(Continued)

FOREIGN PATENT DOCUMENTS

JP S53-139185 12/1978
JP S56-081453 U 7/1981
(Continued)

OTHER PUBLICATIONS

International Search Report mailed on Dec. 10, 2013.

*Primary Examiner* — Anthony R. Jimenez
(74) *Attorney, Agent, or Firm* — IPUSA, PLLC

(57) ABSTRACT

A switch includes a fixed contact part including a fixed contact, a movable contact part including a movable contact, a control button, an operation part including a first end and a second end, and a lock. When the first end is pressed, the control button is pressed by the operation part, the movable contact touches the fixed contact, and the switch becomes an ON state. While the movable contact and the fixed contact are in contact with each other, a first protrusion of the lock touches an engaging part of the control button to limit movement of the control button and maintain the ON state. When the second end is pressed, the operation part touches a second protrusion of the lock and moves the lock in such
(Continued)

a direction that the first protrusion moves away from the engaging part, and the switch becomes the OFF state.

11 Claims, 29 Drawing Sheets

(51) Int. Cl.

| | |
|---|---|
| ***H01H 3/58*** | (2006.01) |
| ***H01H 23/20*** | (2006.01) |
| ***H01H 23/04*** | (2006.01) |
| *H01H 5/04* | (2006.01) |
| *H01H 9/44* | (2006.01) |
| *H01H 23/16* | (2006.01) |

(52) U.S. Cl.
CPC ..... *H01H 5/045* (2013.01); *H01H 9/443* (2013.01); *H01H 23/164* (2013.01); *H01H 23/168* (2013.01); *H01H 2221/016* (2013.01); *H01H 2221/044* (2013.01); *H01H 2239/03* (2013.01); *H01H 2239/044* (2013.01)

(58) Field of Classification Search
USPC ... 200/43.11, 400, 401, 17 R, 468, 522, 520, 200/405, 402, 553, 538, 537, 563, 339, 200/239, 556, 560, 564, 566, 570, 571, 200/318, 318.1, 318.2, 320, 321, 322, 200/323, 325, 327, 329, 334; 335/9, 15, 335/16, 21, 6, 11, 13, 17,167–171
See application file for complete search history.

(56) References Cited

U.S. PATENT DOCUMENTS 6,225,881 B1 * 5/2001 Felden ..... H01H 71/04 335/167
6,559,398 B2 5/2003 Takeda et al.

FOREIGN PATENT DOCUMENTS

JP H01-060430 U 4/1989
JP 2001-307597 11/2001

* cited by examiner

SWITCH

TECHNICAL FIELD

The present invention relates to a switch.

BACKGROUND ART

There exists a seesaw switch for controlling on and off of, for example, a power source. A surface of a portion of a seesaw switch to be pressed has a wave shape. ON-OFF control can be performed by pressing one or the other end of the pressed part having a wave-shaped surface.

Such a seesaw switch is easy to operate and is therefore often used as a power switch.

RELATED-ART DOCUMENT

Patent Document

[Patent Document 1] Japanese Laid-Open Patent Publication No. 2001-307597

SUMMARY OF INVENTION

Technical Problem

Although a 100 V alternating-current power source is currently used as a commercial power source in Japan, there is a demand for a high-voltage direct-current power source to achieve energy saving and high efficiency. However, when currently-available switches designed for the 100 V alternating-current power source are used for a high-voltage direct-current power source, those switches may be broken or damaged. Specifically, if such a switch is used for a high-voltage direct-current power source, an arc tends to be generated when the switch is turned on and off, particularly when turned off, and the switch itself may be damaged by the heat of the generated arc. When a switch is damaged by heat, the damaged switch becomes either open-circuited or short-circuited. Particularly, when a switch is short-circuited, an electric current continues to flow and cannot be cut off. This may also influence parts other than the switch and worsen the problem.

For the above reasons, there is a demand for a seesaw switch that can be operated in a manner similar to a currently-available power switch and supports a direct current or a high voltage.

Solution to Problem

In an aspect of the embodiments of the present invention, there is provided a switch that includes a fixed contact part including a fixed contact, a movable contact part including a movable contact, a control button that includes an engaging part and supports the movable contact part, an operation part including a first end and a second end, and a lock including a first protrusion and a second protrusion.

The switch is configured such that when the first end is pressed, the control button is pressed, the movable contact touches the fixed contact, and the switch becomes an ON state; and when the second end is pressed, the movable contact moves away from the fixed contact, and the switch becomes an OFF state. While the movable contact and the fixed contact are in contact with each other, the first protrusion of the lock touches the engaging part of the control button to maintain the ON state. When the second end is pressed, the operation part touches the second protrusion of the lock and moves the lock in such a direction that the first protrusion moves away from the engaging part, and the switch becomes the OFF state.

Advantageous Effects of Invention

The present invention makes it possible to provide a seesaw switch that supports a direct current or a high voltage.

DESCRIPTION OF EMBODIMENTS

Embodiments of the present invention are described below. The same reference number is assigned to the same component throughout the accompanying drawings, and repeated descriptions of the same component are omitted.

Configurations of a switch for a high-voltage direct-current power source are described below. When a switch is turned on and off while a high voltage, for example, a high voltage direct current, is being applied between contacts of the switch, an arc is generated between the contacts and an arc current flows even if the contacts are not in contact with each other. When an arc is generated, the contacts are heated by the generated arc and the switch may be broken or damaged. For this reason, there is a demand for a switch having a configuration for preventing generation of an arc or a switch that, even when an arc is generated, can extinguish the arc in a shortest possible period of time.

First Embodiment

Figure 1:
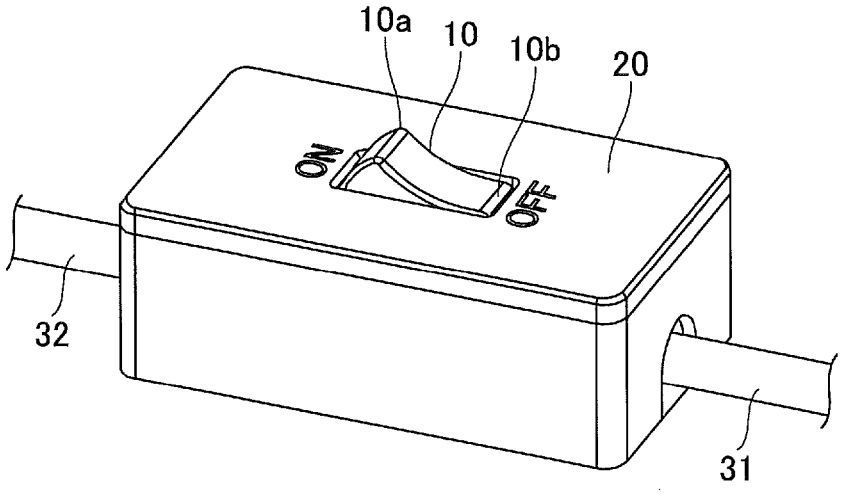
FIG. 1 is a perspective view of a switch according to a first embodiment.
Figure 2:
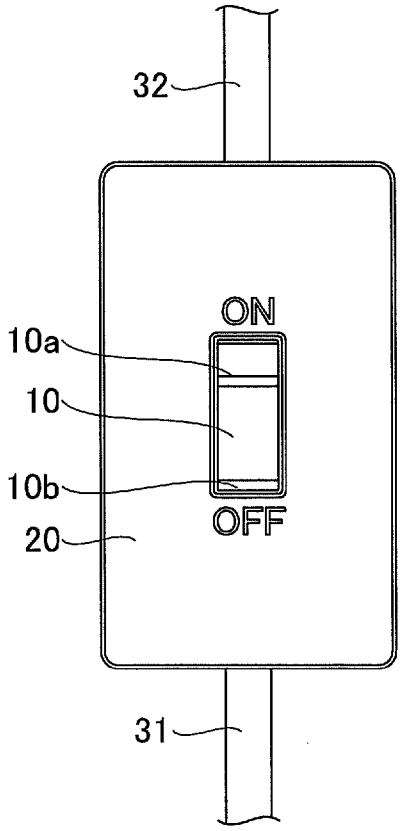
FIG. 2 is a top view of a switch according to the first embodiment.
Figure 3:
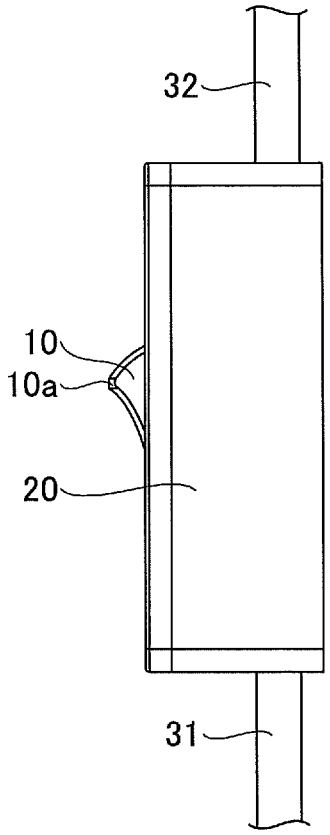
FIG. 3 is a side view of a switch according to the first embodiment.

A switch according to a first embodiment is described with reference to FIGS. 1 through 3. FIG. 1 is a perspective view, FIG. 2 is a top view, and FIG. 3 is a side view of the switch of the present embodiment. The switch of the present embodiment is a seesaw switch and includes an operation part 10 having a wave-shaped surface. The switch of the present embodiment is entirely covered by a case 20, and the wave-shaped operation part 10 protrudes through an opening formed in the case 20. Also, two power cables 31 and 32 are connected to the switch of the present embodiment. The power cable 31 supplies power, e.g., 400 V direct-current power, to the switch.

When a first end 10*a* or a second end 10*b* of the wave-shaped operation part 10 is pressed, the switch is turned on or off. More specifically, when the first end 10*a* of the operation part 10 is pressed by, for example, a finger while the switch is in an OFF state, the switch changes to an ON state, the power cable 31 is electrically connected to the power cable 32, and power is supplied from the power cable 31 to the power cable 32. In this case, the second end 10*b* of the operation part 10 rises. On the other hand, when the second end 10*b* of the operation part 10 is pressed by, for example, a finger while the switch is in the ON state, the switch changes to the OFF state, the electrical connection between the power cable 31 and the power cable 32 is broken, and the supply of power from the power cable 31 to the power cable 32 is stopped. In this case, the first end 10*a* of the operation part 10 rises.

Because the switch is configured such that the second end 10*b* of the operation part 10 rises when the first end 10*a* is pressed and the first end 10*a* rises when the risen second end 10*b* is pressed, the switch is called a seesaw switch.

<Internal Structure>

Figure 4:
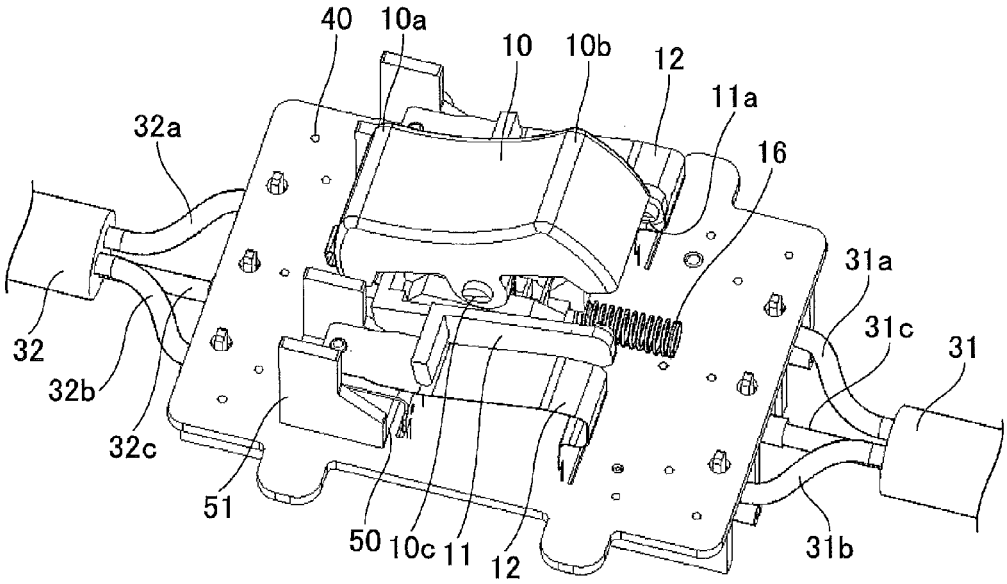
FIG. 4 is a perspective view (1) of the inside of a switch according to the first embodiment.
Figure 5:
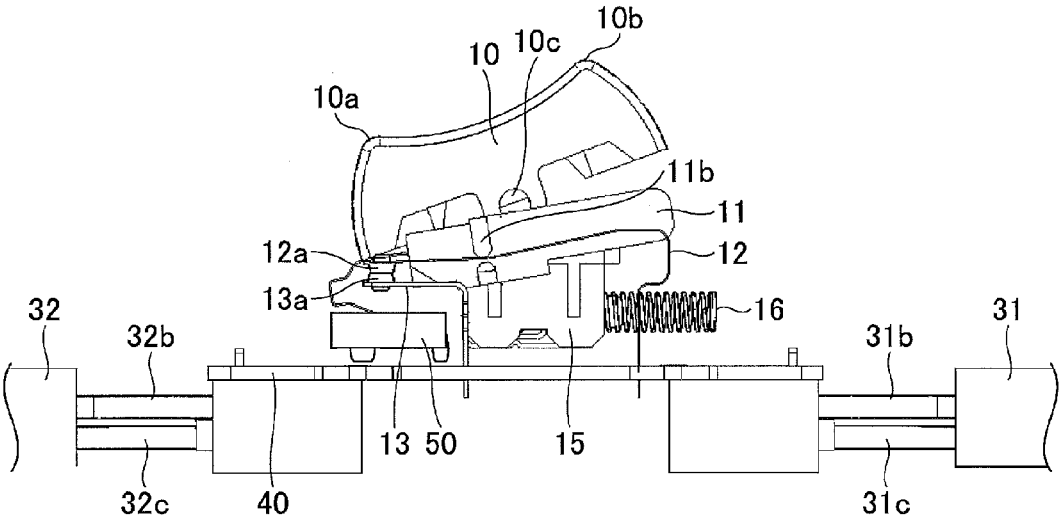
FIG. 5 is a drawing illustrating the inside of a switch according to the first embodiment.
Figure 6:
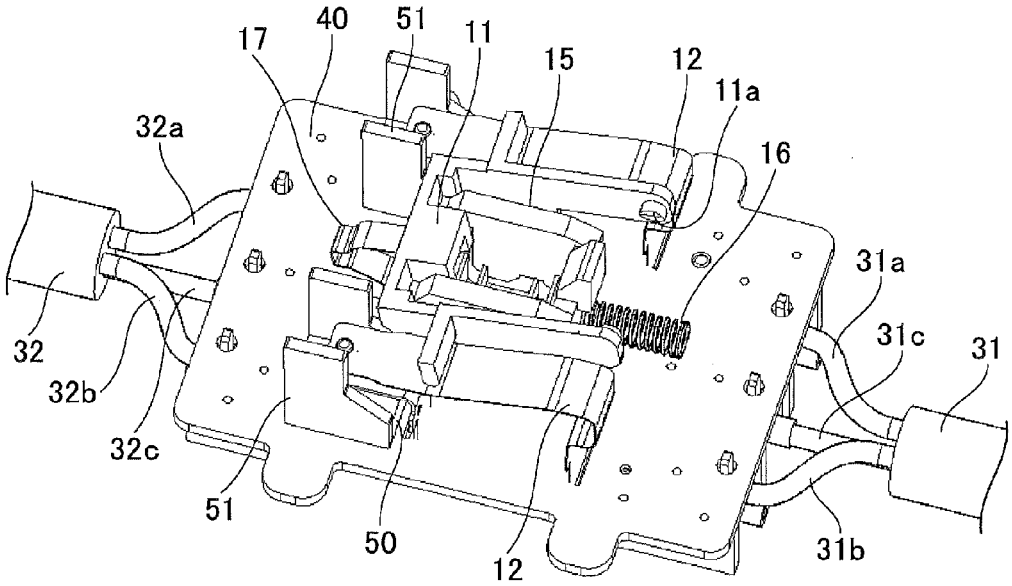
FIG. 6 is a perspective view (2) of the inside of a switch according to the first embodiment.

Next, an internal structure of the switch of the present embodiment is described with reference to FIGS. 4 through 6. FIG. 4 is a perspective view of the switch from which the case 20 is removed. FIG. 5 is a partially transparent side view of the switch. FIG. 6 is a perspective view where the operation part 10 is further removed from the switch illustrated by FIG. 4.

The switch of the present embodiment includes two switching mechanisms each of which includes one movable contact part 12 and one fixed contact part 13. More specifically, a first movable contact part 12 and a first fixed contact part 13 constitute a first switching mechanism, and a second movable contact part 12 and a second fixed contact part 13 constitute a second switching mechanism. A movable contact 12*a* is provided at an end of each movable contact part 12, and a fixed contact 13*a* is provided at an end of each fixed contact part 13. In the switch of the present embodiment, the movable contact part 12 and the fixed contact part 13, except for the movable contact 12*a* and the fixed contact 13*a*, are comprised of a conductive metal material such as a copper (Cu) plate, and the movable contact part 12 has elasticity. The movable contact 12*a* and the fixed contact 13*a* are comprised of, for example, silver (Ag) or a material including a metal such as silver. Also in the present embodiment, components including the movable contact parts 12 and the fixed contact parts 13 are disposed at predetermined positions on a substrate 40.

The switch of the present embodiment becomes the ON state when the movable contact 12*a* of the movable contact part 12 contacts with the fixed contact 13*a* of the fixed contact part 13, and becomes the OFF state when the movable contact 12*a* moves away from the fixed contact 13*a*.

As described above, the power cables 31 and 32 are connected to the switch of the present embodiment. The power cable 31 includes a positive (+) electric wire 31*a*, a negative (−) electric wire 31*b*, and a ground potential (GND) electric wire 31*c*. The power cable 32 includes a positive (+) electric wire 32*a*, a negative (−) electric wire 32*b*, and a ground potential (GND) electric wire 32*c*.

The positive (+) electric wire 31*a* of the power cable 31 is connected to a first one of the two movable contact parts 12, and the negative (−) electric wire 31*b* is connected to a second one of the two movable contact parts 12. The positive (+) electric wire 32*a* of the power cable 32 is connected to a first one of the two fixed contact parts 13, and the negative (−) electric wire 32*b* is connected to a second one of the two fixed contact parts 13. The ground potential (GND) electric wire 31*c* of the power cable 31 and the ground potential (GND) electric wire 32*c* of the power cable 32 are connected to each other in the switch.

<On-Off Operations>

Next, ON-OFF operations of the switch of the present embodiment are described.

First, the ON state is described. The switch of the present embodiment includes a control button 11 below the operation part 10. When the first end 10*a* of the operation part 10 is pressed, the operation part 10 rotates around an operation part rotating shaft 10*c* and presses the control button 11, and the control button 11 rotates around a control button rotating shaft 11*a*. A movable contact support 11*b* of the control button 11 supports a portion of the movable contact part 12. When the control button 11 rotates around the control button rotating shaft 11*a*, the movable contact part 12 supported by the movable contact support 11*b* moves toward the fixed contact part 13, the movable contact 12*a* of the movable contact part 12 contacts with the fixed contact 13*a* of the fixed contact part 13 as illustrated by FIG. 6, and the switch becomes the ON state. As the two movable contacts 12*a* contact the corresponding fixed contacts 13*a* in the ON state, the positive (+) electric wire 31*a* of the power cable 31 and the positive (+) electric wire 32*a* of the power cable 32 are electrically connected to each other, the negative (−) electric wire 31*b* of the power cable 31 and the negative (−) electric wire 32*b* of the power cable 32 are electrically connected to each other. As a result, power is supplied from the power cable 31 to the power cable 32.

Figure 7:
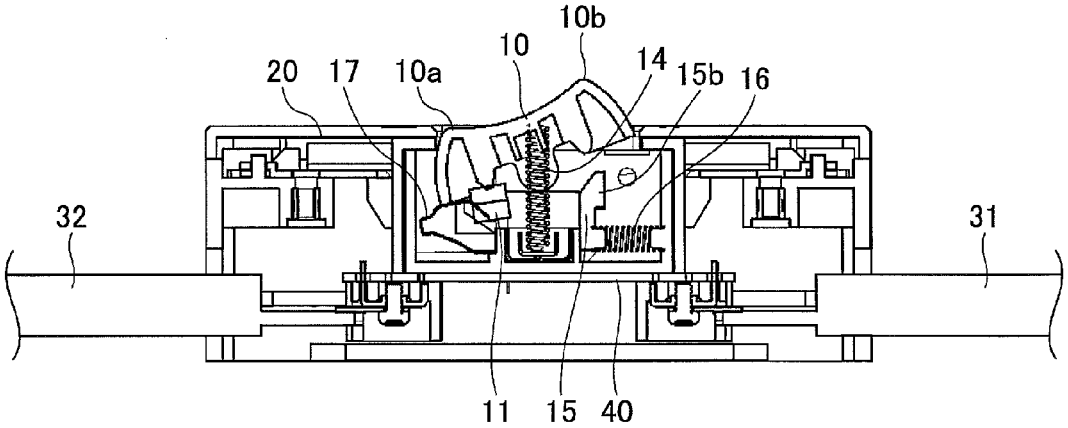
FIG. 7 is a drawing (1) illustrating the inside of a switch in an ON state according to the first embodiment.
Figure 8:
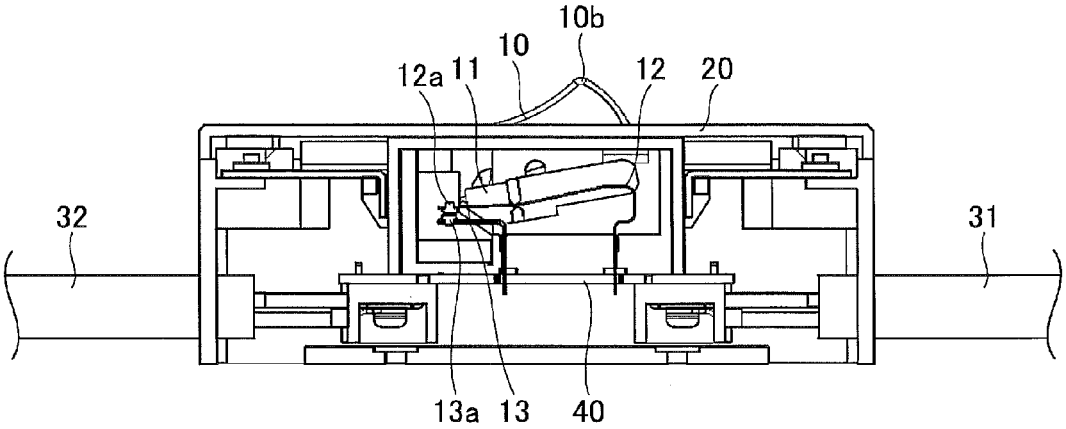
FIG. 8 is a drawing (2) illustrating the inside of a switch in an ON state according to the first embodiment.
Figure 9:
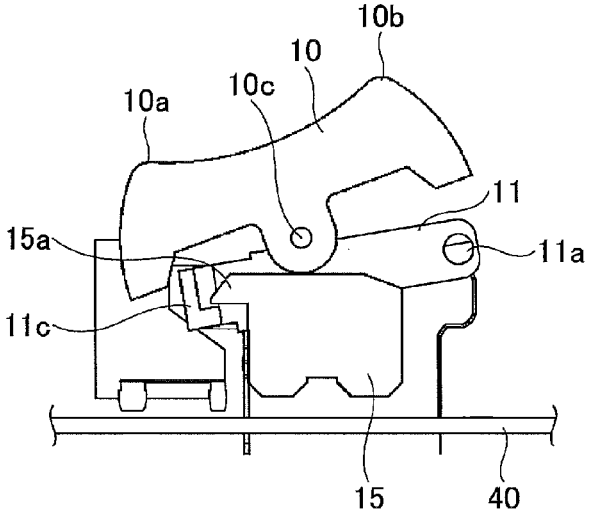
FIG. 9 is a drawing (1) illustrating a switch in an ON state according to the first embodiment.
Figure 10:
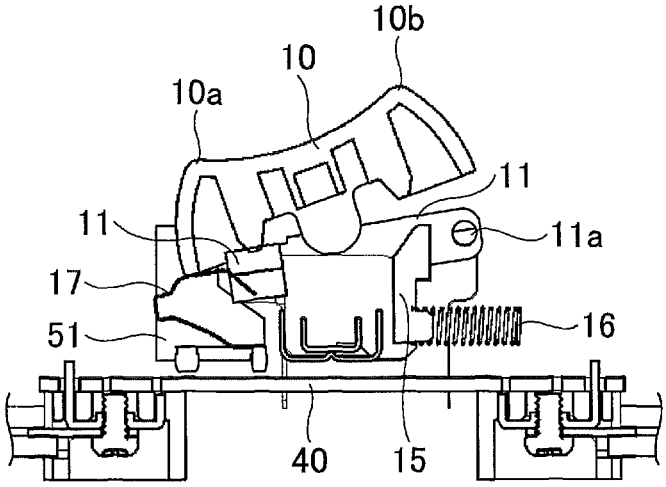
FIG. 10 is a drawing (2) illustrating a switch in an ON state according to the first embodiment.
Figure 11:
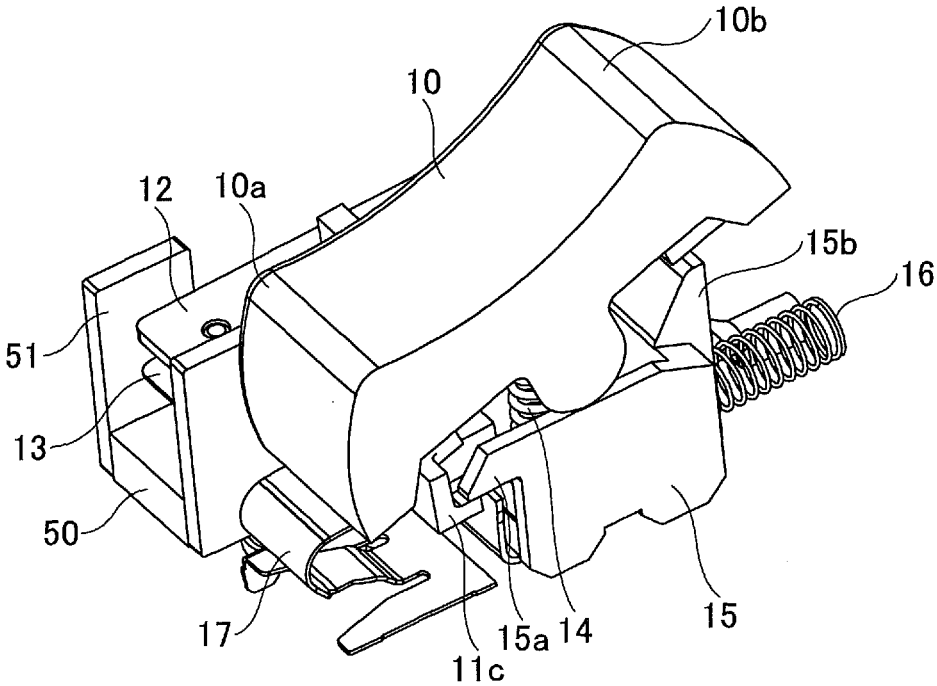
FIG. 11 is a drawing (3) illustrating a switch in an ON state according to the first embodiment.

The ON state of the switch of the present embodiment is described in more detail with reference to FIGS. 7 through 11. FIG. 7 is a cut-away side view of the switch in the ON state, and FIG. 8 is a cut-away side view of a portion, which is different from FIG. 7, of the switch in the ON state. FIG. 9 is a cut-away side view of a portion of the switch in the ON state, and FIG. 10 is a cut-away side view of a portion, which is different from FIG. 9, of the switch in the ON state. FIG. 11 is a perspective view of a portion of the switch.

The switch of the present embodiment becomes the ON state when the first end 10*a* of the operation part 10 is pressed while the switch is in the OFF state, and the ON state is maintained by a force of an operation part spring 14. In FIG. 7, for illustration purposes, the operation part spring 14 is illustrated as being in a straight shape. In practice, however, when the first end 10*a* of the operation part 10 is pressed, the operation part spring 14 may be bent into a dog-leg shape and maintains the ON state. When the first end 10*a* is pressed, a lock 15 is pressed by the restoring force of a lock spring 16 and moves to the left in FIG. 7 substantially parallel to the substrate 40, and a first protrusion 15*a* at an end of the lock 15 engages with an L-shaped engaging part 11*c* of the control button 11. In this state, as illustrated by FIG. 9, the control button 11 is held by the first protrusion 15*a* engaging with the engaging part 11*c*. Therefore, even when the operation part 10 slightly rotates around the operation part rotating shaft 10*c*, the movable contact 12*a* and the fixed contact 13*a* are kept in contact with each other and the ON state is maintained. The switch of the present embodiment also includes a return spring 17 connected to the control button 11. In the ON state, as illustrated by FIGS. 10 and 11, the return spring 17 is pressed by the control button 11 or the operation part 10 and is contracted.

Figure 12:
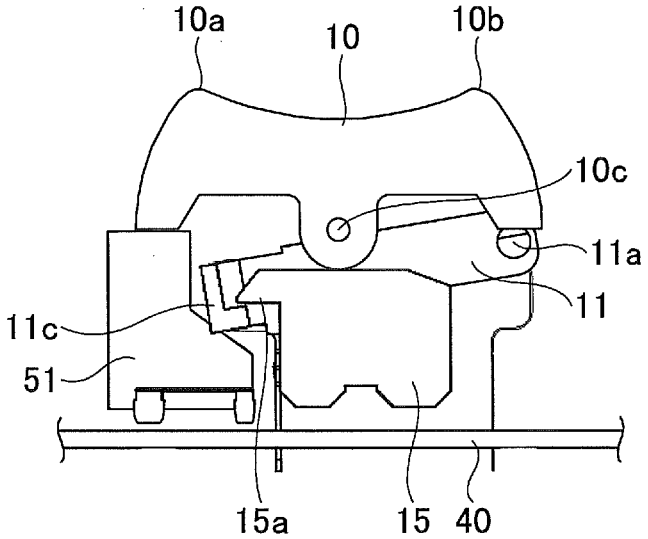
FIG. 12 is a drawing (1) illustrating a switch changing from an ON state to an OFF state according to the first embodiment.

Next, a state of the switch between the ON state and the OFF state is described with reference to FIGS. 12 and 13. FIG. 12 is a cut-away side view of a portion of the switch in a state between the ON state and the OFF state, and FIG. 13 is a cut-away side view of a portion of the switch, which is different from FIG. 12, in this state.

Figure 13:
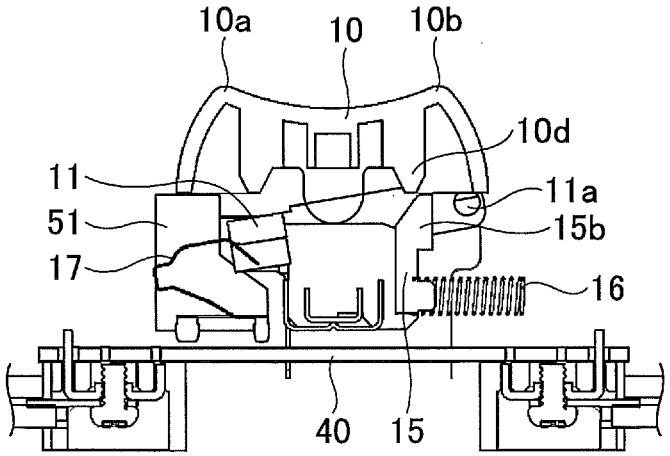
FIG. 13 is a drawing (2) illustrating a switch changing from an ON state to an OFF state according to the first embodiment.

In the present embodiment, when the second end 10*b* of the operation part 10 is pressed while the switch is in the ON state illustrated by FIG. 10, the operation part 10 rotates around the operation part rotating shaft 10*c*, and the switch changes into a transient state as illustrated by FIGS. 12 and 13. In the transient state, although the force of the operation part 10 pressing the control button 11 is lost, the control button 11 does not rotate around the control button rotating shaft 11*a* and the contact between the movable contact 12*a* and the fixed contact 13*a* is maintained, because the first protrusion 15*a* of the lock 15 engages with the engaging part 11*c* of the control button 11 and holds the control button 11. Thus, the ON state is maintained.

Figure 14:
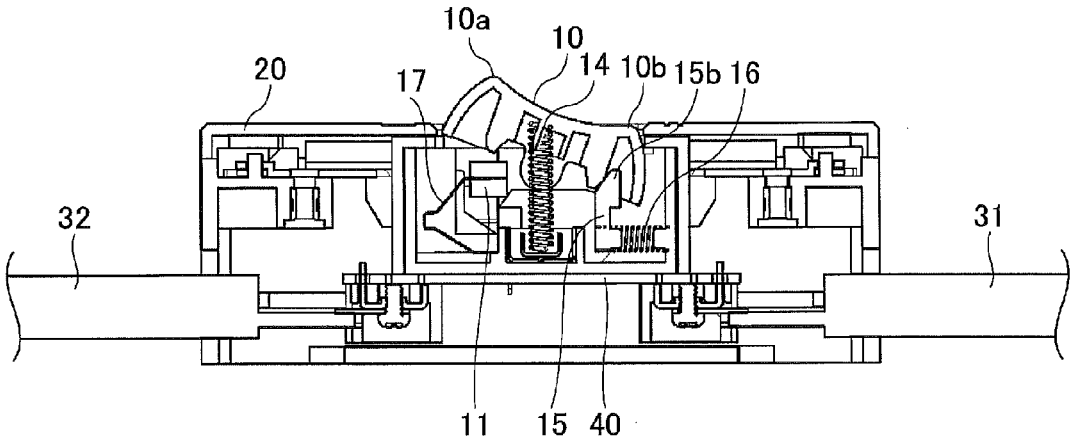
FIG. 14 is a drawing (1) illustrating the inside of a switch in an OFF state according to the first embodiment.
Figure 15:
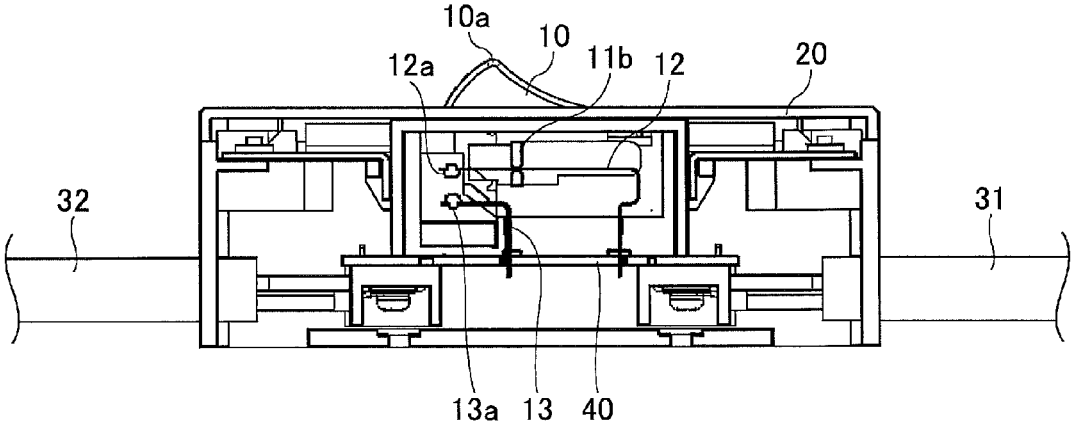
FIG. 15 is a drawing (2) illustrating the inside of a switch in an OFF state according to the first embodiment.
Figure 16:
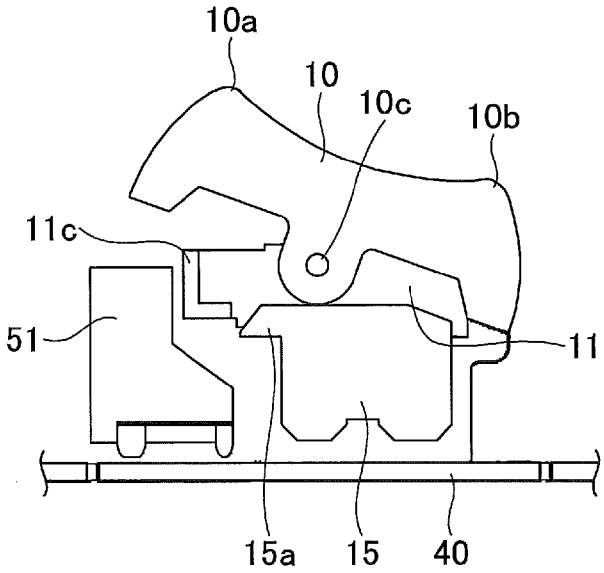
FIG. 16 is a drawing (1) illustrating a switch in an OFF state according to the first embodiment.
Figure 17:
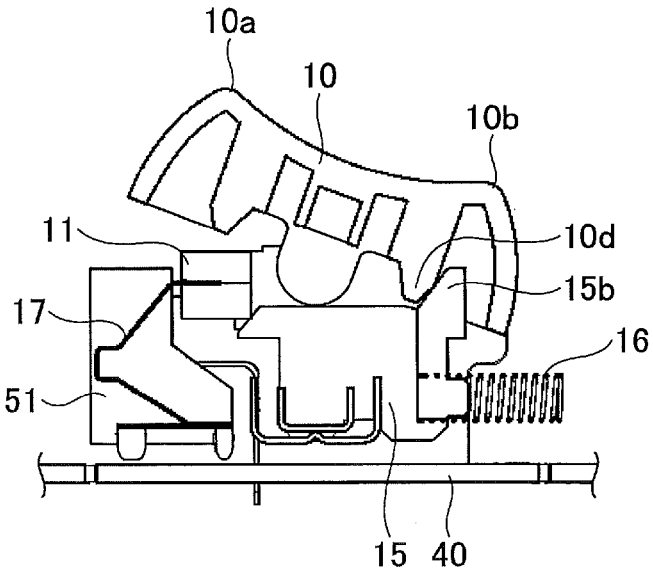
FIG. 17 is a drawing (2) illustrating a switch in an OFF state according to the first embodiment.
Figure 18:
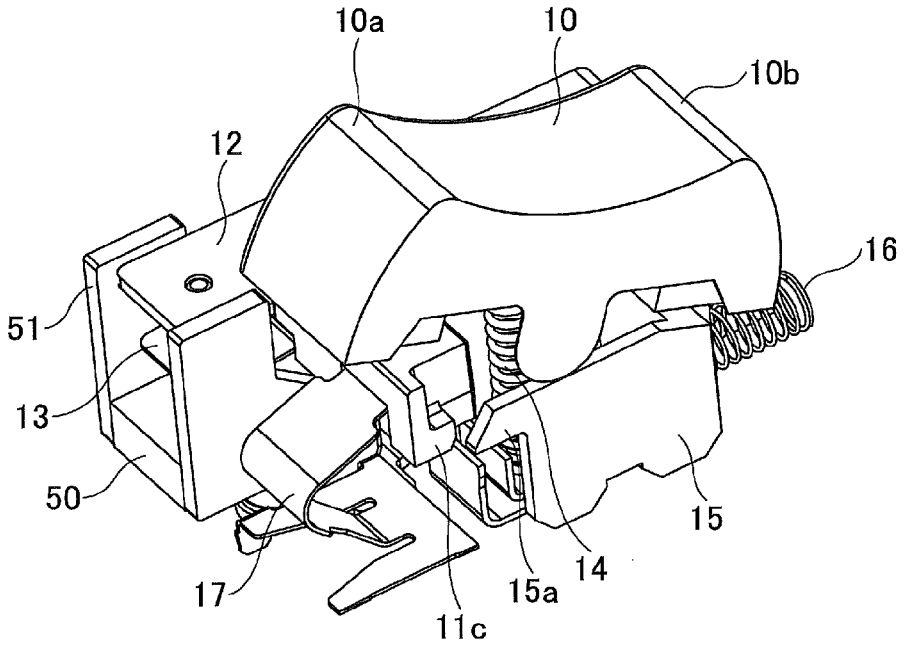
FIG. 18 is a drawing (3) illustrating a switch in an OFF state according to the first embodiment.

Next, the OFF state is described with reference to FIGS. 14 through 18. FIG. 14 is a cut-away side view of the switch in the OFF state, and FIG. 15 is a cut-away side view, which is different from FIG. 14, of the switch in the OFF state. FIG. 16 is a cut-away side view of a portion of the switch in the ON state, FIG. 17 is a cut-away side view, which is different from FIG. 16, of a portion of the switch in the ON state, and FIG. 18 is a perspective view of a portion of the switch.

The switch of the present embodiment becomes the OFF state when the second end 10*b* of the operation part 10 is pressed further from the position illustrated in FIGS. 12 and 13. The OFF state is maintained by the force of the operation part spring 14. In FIG. 14, for illustration purposes, the operation part spring 14 is illustrated as being in a straight shape. In practice, however, when the second end 10*b* of the operation part is pressed, the operation part spring 14 may be bent into a dog-leg shape and maintains the OFF state.

When the second end 10*b* of the operation part 10 is pressed further from the position in the transient state illustrated by FIGS. 12 and 13, the operation part rotates further around the operation part rotating shaft 10*c*. When the operation part 10 rotates, a lock releasing part 10*d*, shaped like a protrusion, of the operation part 10 touches a second protrusion 15*b* of the lock 15 facing the operation part 10. The second protrusion 15*b* has a sloping end. When an end of the lock releasing part 10*d* of the operation part 10 moves along the sloping end of the second protrusion 15*b*, the lock 15 moves, parallel to the substrate 40, against the restoring force of the lock spring 16 to the right from a position illustrated in FIG. 12. As a result, the first protrusion 15*a* of the lock 15 moves away from the engaging part 11*c* of the control button 11 and the control button 11 is released from the lock 15. Then, the control button 11 is pressed by the restoring force of the return spring 17, and swiftly moves upward around the control button rotating shaft 11*a*. When the control button 11 moves upward, the movable contact part 12 supported by the movable contact support 11*b* moves away from the fixed contact part 13, and the contact between the movable contact 12*a* and the fixed contact 13*a* is broken as illustrated by FIG. 15. The switch of the present embodiment is changed from the ON state to the OFF state by the restoring force of the return spring 17, and therefore can be turned off in a short period of time.

Because the switch of the present embodiment can be changed from the ON state to the OFF state in a very short period of time by the restoring force of the return spring 17, no arc is generated between the movable contact 12*a* and the fixed contact 13*a*, or an arc is generated only for a very short period of time. Accordingly, the switch is not damaged due to, for example, the melting of the movable contact part 12.

<Arc Extinguishing Function>

Figure 19:
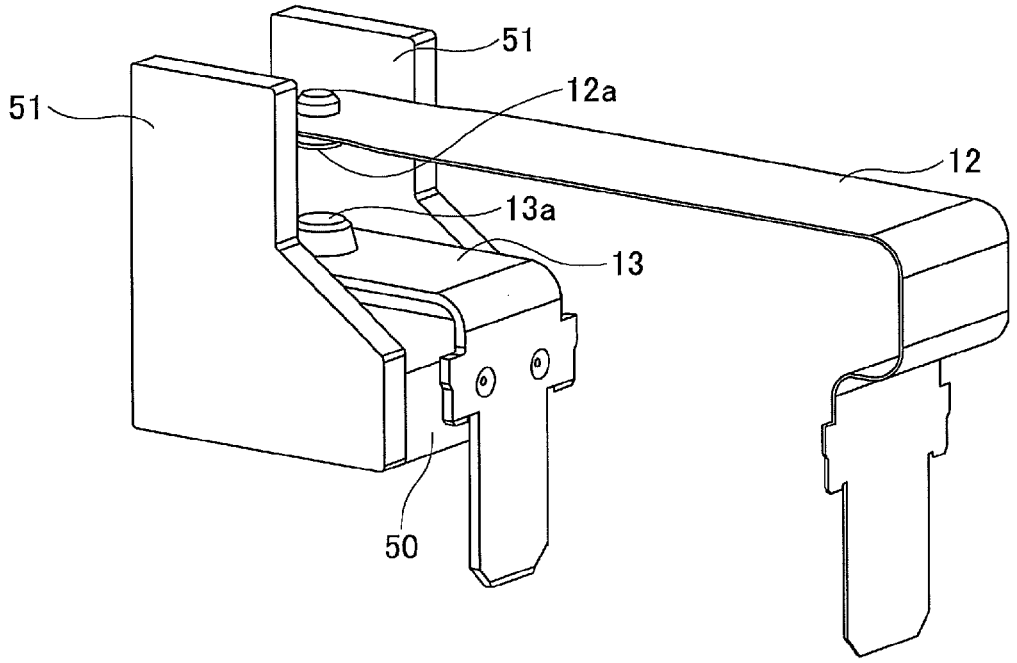
FIG. 19 is a drawing (1) illustrating a permanent magnet of a switch of the first embodiment.
Figure 20:
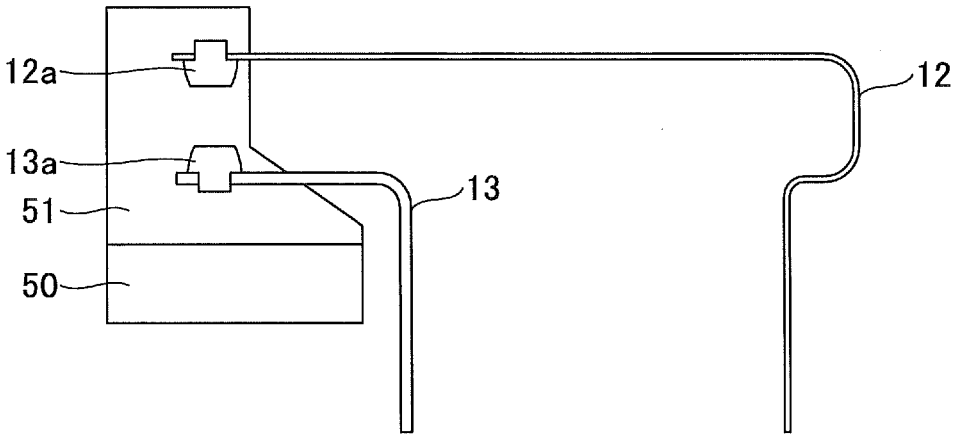
FIG. 20 is a drawing (2) illustrating a permanent magnet of a switch of the first embodiment.

The switch of the present embodiment includes a function for instantly extinguishing an arc generated between the movable contact 12*a* and the fixed contact 13*a*. As illustrated by FIGS. 19 and 20, the switch of the present embodiment includes a permanent magnet 50 below the fixed contact 13*a*. An arc generated between the movable contact 12*a* and the fixed contact 13*a* is instantly extinguished by a magnetic field generated by the permanent magnet 50. Because an arc is a flow of electrons, when a magnetic field exists, the magnetic field applies a force to the electrons, and blows off and extinguishes the arc. In the present embodiment, two yokes 51 are provided in contact with the permanent magnet 50 so that a magnetic field is efficiently applied between the movable contact 12*a* and the fixed contact 13*a*. The two yokes 51 are disposed on the corresponding sides of the permanent magnet 50, the movable contact 12*a*, and the fixed contact 13*a*. This configuration makes it possible to apply a magnetic field between the movable contact 12*a* and the fixed contact 13*a*. More specifically, this configuration makes it possible to apply a magnetic field in a direction that is substantially perpendicular to a line connecting the movable contact 12*a* and the fixed contact 13*a*. FIG. 19 is a perspective view and FIG. 20 is a cut-away side view illustrating the arrangement of the permanent magnet 50 and the yokes 51.

Second Embodiment

Figure 21:
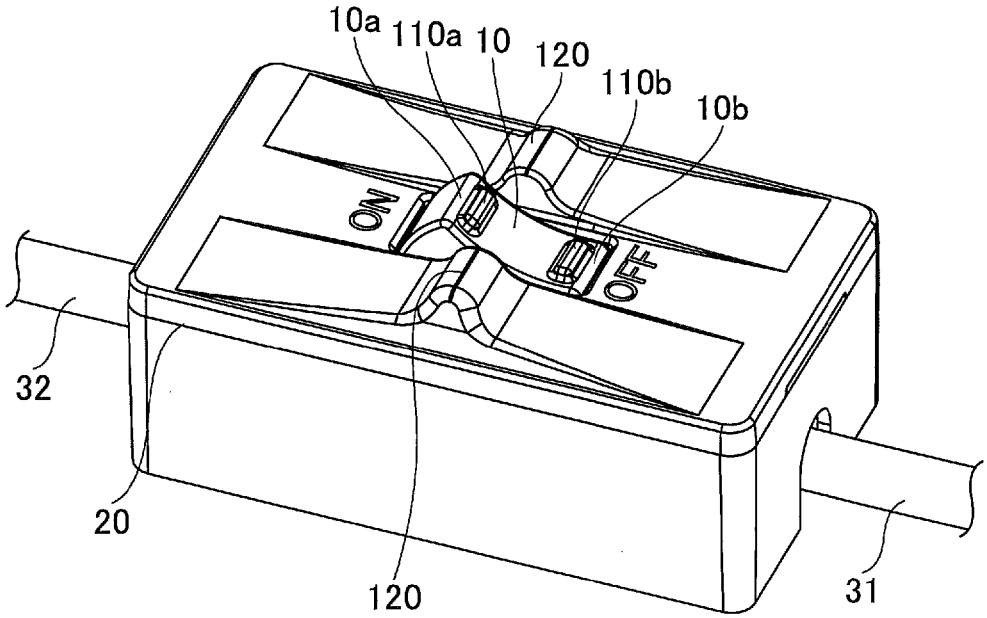
FIG. 21 is a perspective view of a switch according to a second embodiment.
Figure 22:
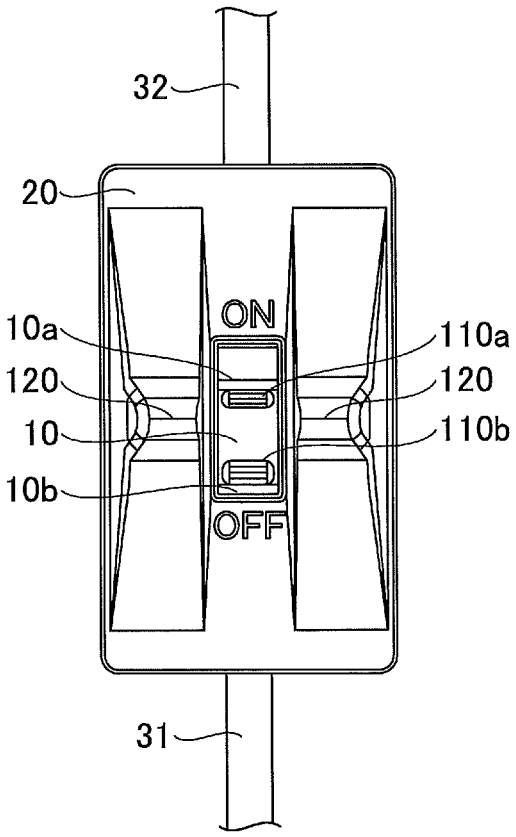
FIG. 22 is a top view of a switch according to the second embodiment.
Figure 23:
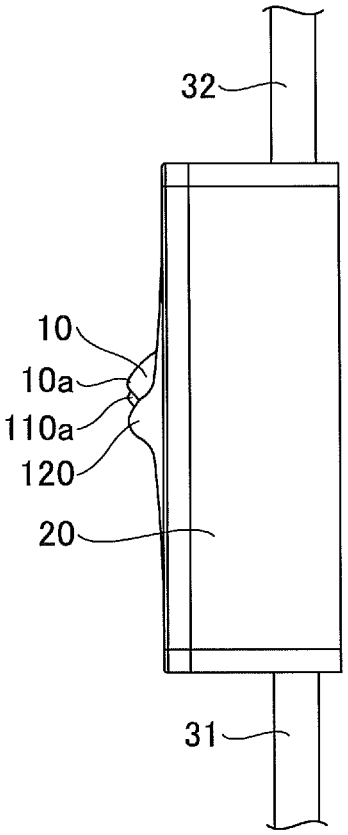
FIG. 23 is a side view of a switch according to the second embodiment.

Next, a second embodiment is described. In a switch of the present embodiment, as illustrated by FIGS. 21 through 23, a mound-shaped raised part 120 is provided on the case 20 on each side of the operation part 10. The raised part 120 is provided on each side of the central portion of the operation part 10 having a wave-shaped surface. FIG. 21 is a perspective view, FIG. 22 is a top view, and FIG. 23 is a side view of the switch of the present embodiment.

In the first embodiment, the transient state illustrated by FIGS. 12 and 13 is still the ON state, and the state illustrated by FIGS. 14 through 18 is the OFF state. Therefore, the movable contact 12*a* moves away from the fixed contact 13*a* when the switch changes from the state illustrated by FIGS. 12 and 13 to the state illustrated by FIGS. 14 through 18. However, because the operation part 10 is operated by touching the operation part 10 directly with a finger, an arc may be generated multiple times due to chattering or generated for a long period of time if, for example, the operation with a finger is stopped around the time when the movable contact 12*a* moves away from the fixed contact 13*a*. In this case, the switch may be damaged by an arc generated between the movable contact 12*a* and the fixed contact 13*a*.

In the switch of the present embodiment, the raised part 120 is provided on the case 20 on each side of the operation part 10 to prevent an operation with a finger from being stopped around the time when the movable contact 12*a* moves away from the fixed contact 13*a*. This configuration makes it possible to more reliably turn on or off the operation part 10 in a short period of time and prevent the switch from being damaged.

Also in the switch of the present embodiment, operation protrusions 110*a* and 110*b* are provided near the first end 10*a* and the second end 10*b* of the operation part 10. The operation protrusions 110*a* and 110*b* prevent a finger operating the operation part 10 from slipping on the surface of the operation part 10, and make it possible to more effectively prevent an operation with a finger from being stopped around the time when the movable contact 12*a* moves away from the fixed contact 13*a*. Other configurations of the second embodiment not described above are substantially the same as those of the first embodiment.

Third Embodiment

Figure 24:
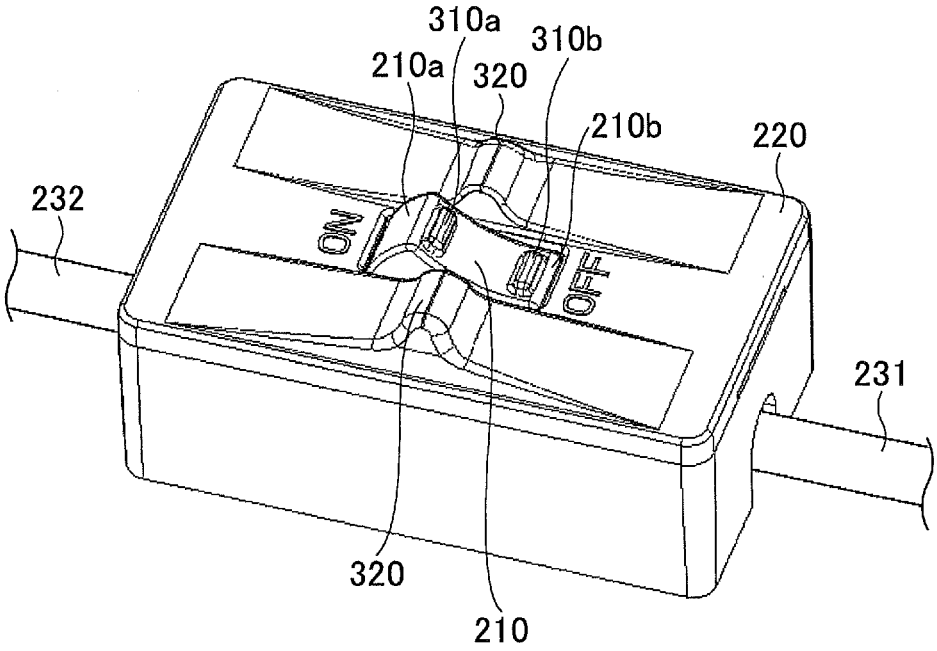
FIG. 24 is a perspective view of a switch according to a third embodiment.
Figure 25:
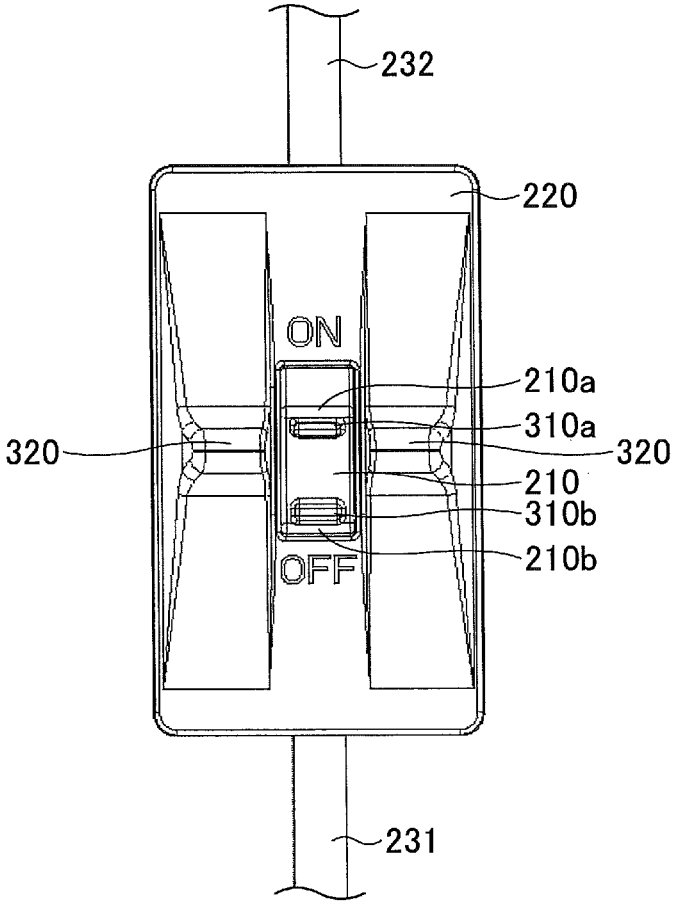
FIG. 25 is a top view of a switch according to the third embodiment.
Figure 26:
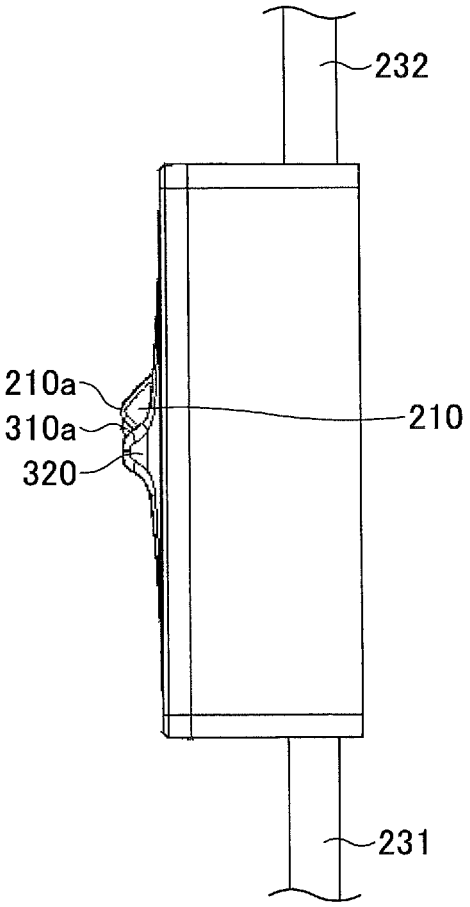
FIG. 26 is a side view of a switch according to the third embodiment.

Next, a switch according to a third embodiment is described with reference to FIGS. 24 through 26. FIG. 24 is a perspective view, FIG. 25 is a top view, and FIG. 26 is a side view of the switch of the present embodiment. Similarly to the first embodiment, the switch of the present embodiment is a seesaw switch and includes a wave-shaped operation part 210. The switch of the present embodiment is entirely covered by a case 220, and the operation part 210 protrudes through an opening formed in the case 220. Also, two power cables 231 and 232 are connected to the switch of the present embodiment. The power cable 231 supplies power, e.g., 400 V direct-current power, to the switch.

When a first end 210*a* or a second end 210*b* of the operation part 210 is pressed, the switch is turned on or off. When the first end 210*a* of the operation part 210 is pressed while the switch is in the OFF state, the switch changes to the ON state, the power cable 231 is electrically connected to the power cable 232, and power is supplied. In this case, the second end 210*b* of the operation part 210 rises. On the other hand, when the second end 210*b* of the operation part 210 is pressed while the switch is in the ON state, the switch changes to the OFF state, the electrical connection between the power cable 231 and the power cable 232 is broken, and the supply of power is stopped. In this case, the first end 210*a* of the operation part 210 rises.

In the switch of the present embodiment, similarly to the switch of FIG. 21, a mound-shaped raised part 320 is provided on the case 220 on each side of the central portion of the operation part 210. Because the operation part 210 is operated by touching the operation part 210 with a finger, an arc may be generated multiple times due to chattering or generated for a long period of time if the operation is stopped around the time when a movable contact moves away from a fixed contact. In this case, the switch may be damaged by an arc generated between the movable contact and the fixed contact. In the switch of the present embodiment, the raised part 320 is provided on the case 220 on each side of the operation part 210 to prevent an operation with a finger from being stopped around the time when the movable contact moves away from the fixed contact. This configuration makes it possible to more reliably turn on or off the operation part 210 in a short period of time and prevent the switch from being damaged.

Also in the switch of the present embodiment, operation protrusions 310*a* and 310*b* are provided near the first end 210*a* and the second end 210*b* of the operation part 210. The operation protrusions 310*a* and 310*b* make it possible to prevent a finger from slipping on the surface of the operation part 210 and prevent occurrence of chattering.

<Internal Structure>

Figure 27:
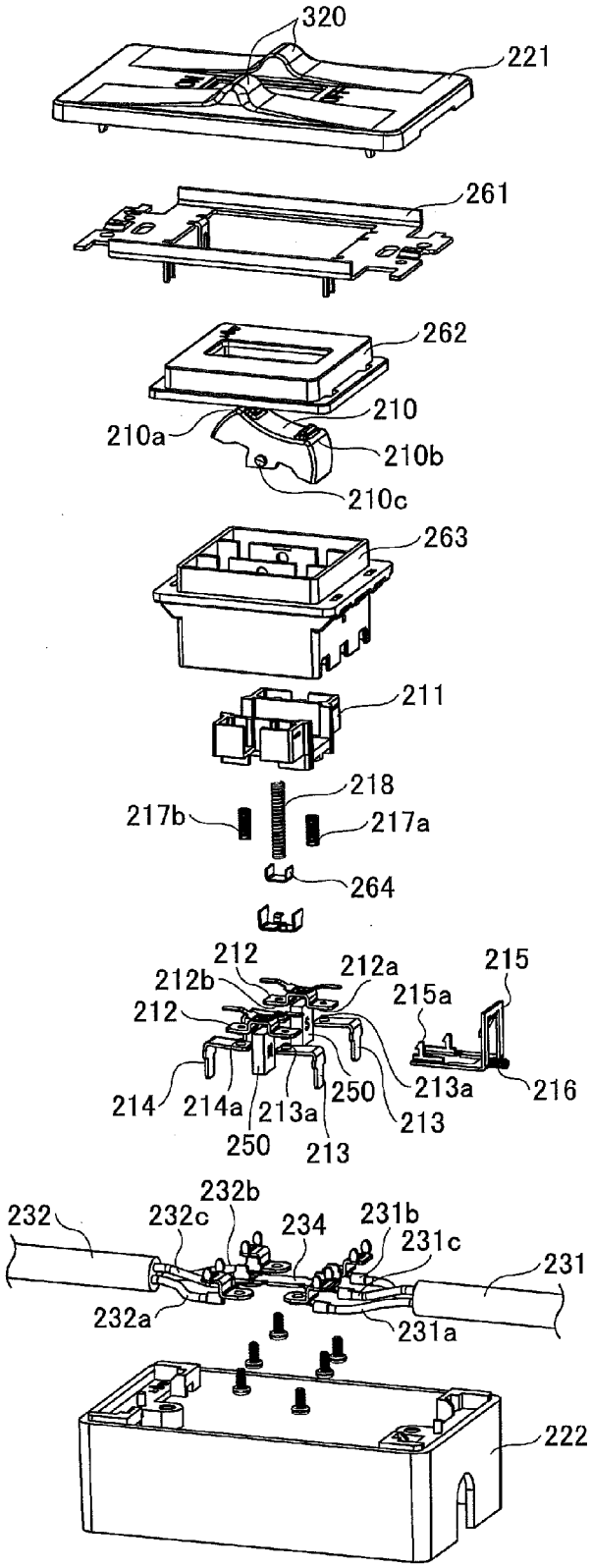
FIG. 27 is an exploded perspective view of a switch according to the third embodiment.
Figure 28:
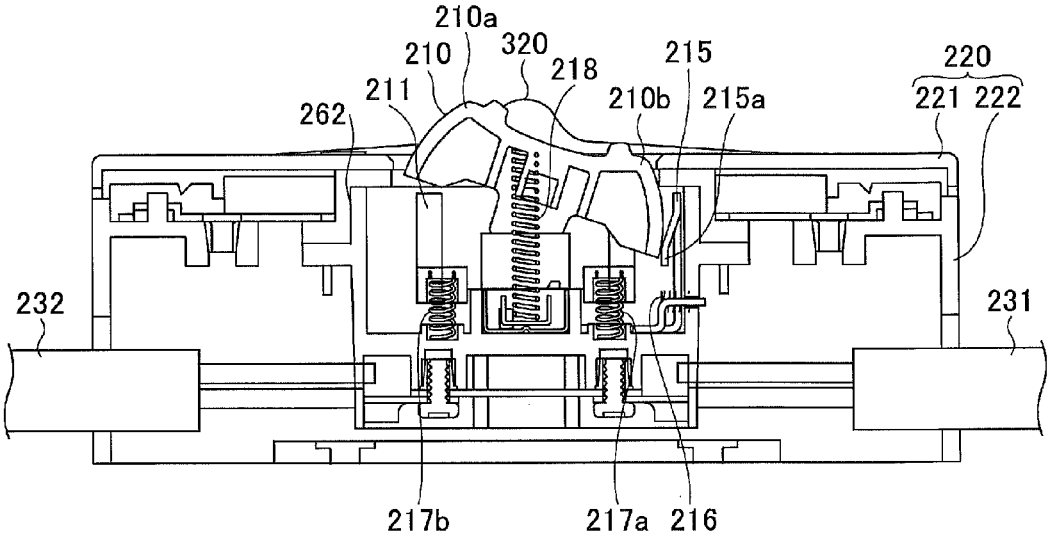
FIG. 28 is a cut-away side view (1) of the inside of a switch according to the third embodiment.
Figure 29:
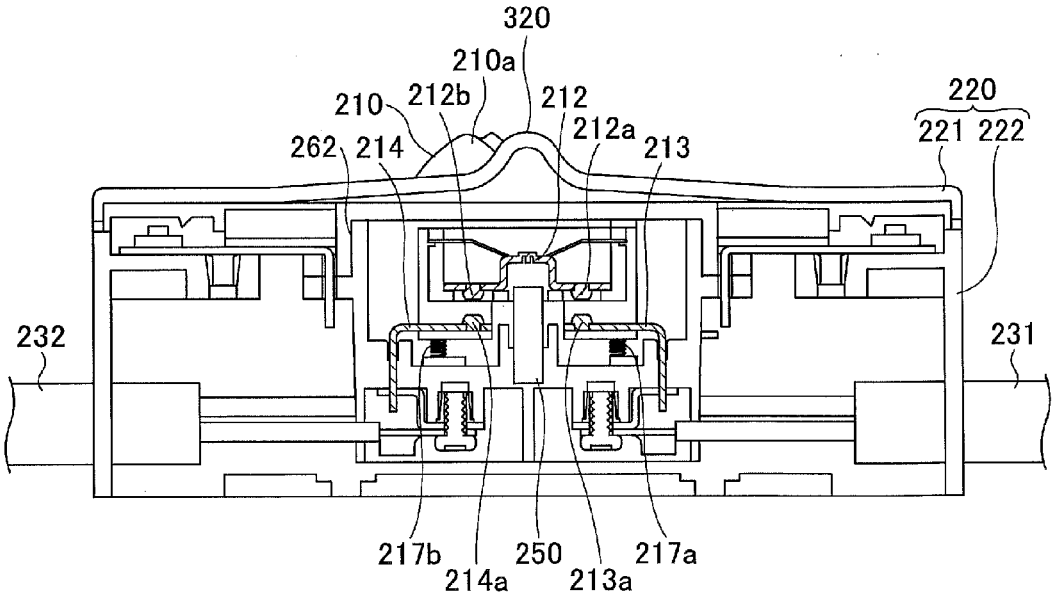
FIG. 29 is a cut-away side view (2) of the inside of a switch according to the third embodiment.

Next, an internal structure of the switch of the present embodiment is described with reference to FIGS. 27 through 29. FIG. 27 is an exploded perspective view of the switch of the present embodiment, FIG. 28 is a cut-away side view of a portion of the switch where the operation part 210 is disposed, and FIG. 29 is a cut-away side view of a portion of the switch where fixed contacts and movable contacts are disposed.

The case 220 includes an upper plate 221 and a lower case 222. The switch includes, in the case 220, an inner plate 261, an operation part inner cover 262 having an opening at a position where the operation part 210 is placed, an inner box 263, a control button 211 that transmits an operation on the operation part 210 to movable contact parts 212, an operation part spring 218 that maintains the operation part 210 in the ON state or the OFF state, return springs 217*a* and 217*b* that raise the control button 211 in the OFF state, an operation part spring support 264 that supports a lower part of the operation part spring 218, a lock 215 and a lock spring 216 for maintaining the ON state, and a permanent magnet 250.

The switch of the present embodiment includes two switching mechanisms each of which includes one movable contact part 212 and two fixed contact parts 213 and 214. More specifically, a first movable contact part 212, a first fixed contact part 213, and a first fixed contact part 214 constitute a first switching mechanism, and a second movable contact part 212, a second fixed contact part 213, and a second fixed contact part 214 constitute a second switching mechanism.

Each movable contact part 212 includes two movable contacts 212*a* and 212*b*. Each fixed contact part 213 includes one fixed contact 213*a*, and each fixed contact part 214 includes one fixed contact 214*a*. In the switch illustrated by FIG. 27, when the fixed contact 213*a* of the fixed contact part 213 contacts the movable contact 212*a* of the movable contact part 212 and the fixed contact 214*a* of the fixed contact part 214 contacts the movable contact 212*b* of the movable contact part 212, the fixed contact part 213 and the fixed contact part 214 are electrically connected via the movable contact part 212. With this configuration, power can be supplied from a side where the fixed contact part 213 is disposed to a side where the fixed contact part 214 is disposed. The movable contact part 212 and the fixed contact parts 213 and 214, except for the movable contacts 212*a* and 212*b* and the fixed contacts 213*a* and 214*a*, are comprised of a conductive metal material such as a copper (Cu) plate or a metal plate including copper. The movable contacts 212*a* and 212*b* and the fixed contacts 213*a* and 214*a* are made of, for example, silver (Ag) or a material including silver.

The switch of the present embodiment becomes the ON state when the movable contact 212*a* of the movable contact part 212 contacts the fixed contact 213*a* of the fixed contact part 213 and the movable contact 212*b* contacts the fixed contact 214*a* of the fixed contact part 214, and becomes the OFF state when the contacts are separated from each other. In the present embodiment, the movable contact part 212 needs not have elasticity and therefore can be formed to have a large thickness. That is, the movable contact part 212 can be formed to have a low resistance and a high heat capacity. Therefore, even when a high voltage power is supplied and an arc is generated, the movable contact part 212 is not deformed or melted by heat of the arc.

As described above, the power cables 231 and 232 are connected to the switch of the present embodiment. The power cable 231 includes a positive (+) electric wire 231*a*, a negative (−) electric wire 231*b*, and a ground potential (GND) electric wire 231*c*. The power cable 232 includes a positive (+) electric wire 232*a*, a negative (−) electric wire 232*b*, and a ground potential (GND) electric wire 232*c*.

The positive (+) electric wire 231*a* of the power cable 231 is connected to a first one of the two fixed contact parts 213, and the negative (−) electric wire 231*b* is connected to a second one of the two fixed contact parts 213. The positive (+) electric wire 232*a* of the power cable 232 is connected to a first one of the two fixed contact parts 214, and the negative (−) electric wire 232*b* is connected to a second one of the two fixed contact parts 214. The ground potential (GND) electric wire 231*c* of the power cable 231 and the ground potential (GND) electric wire 232*c* of the power cable 232 are connected to each other via a connecting part 234 comprised of, for example, a metal material.

Also in the switch of the present embodiment, to support a high voltage direct current, a wire whose conductor has a cross-sectional area of 3.5 $mm^2$ is used for each of the positive (+) electric wire 231*a* and the negative (−) electric wire 231*b* of the power cable 231 and the positive (+) electric wire 232*a* and the negative (−) electric wire 232*b* of the power cable 232. For this reason, to make the movable contact part 212 have a conductance greater than or equal to the conductance of the positive (+) electric wire 231*a*, etc. of the power cable 231, the cross-sectional area of the movable contact part 212 in a direction perpendicular to a current flow direction is preferably greater than or equal to the cross-sectional area of the conductor of the positive (+) electric wire 231*a*, etc. of the power cable 231, i.e., 3.5 $mm^2$. When the width of a cross section of the movable contact part 212 perpendicular to the current flow direction is 7 mm, the thickness of the movable contact part 212 is preferably greater than or equal to 0.5 mm. In the switch of the present embodiment, the cross section of the movable contact part 212 which is perpendicular to the current flow direction has a width of 7 mm and a thickness of 1 mm.

<On-Off Operations>

Next, ON-OFF operations of the switch of the present embodiment are described.

Figure 30:
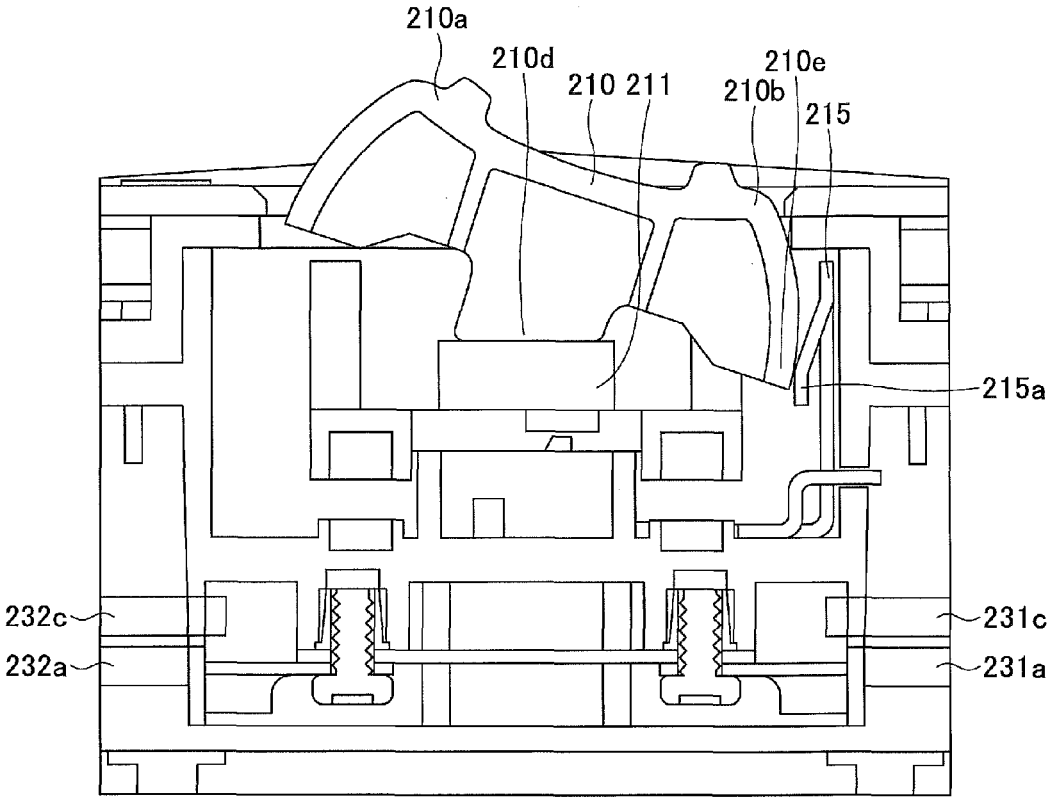
FIG. 30 is a cut-away side view (1) of a switch in an OFF state according to the third embodiment.
Figure 31:
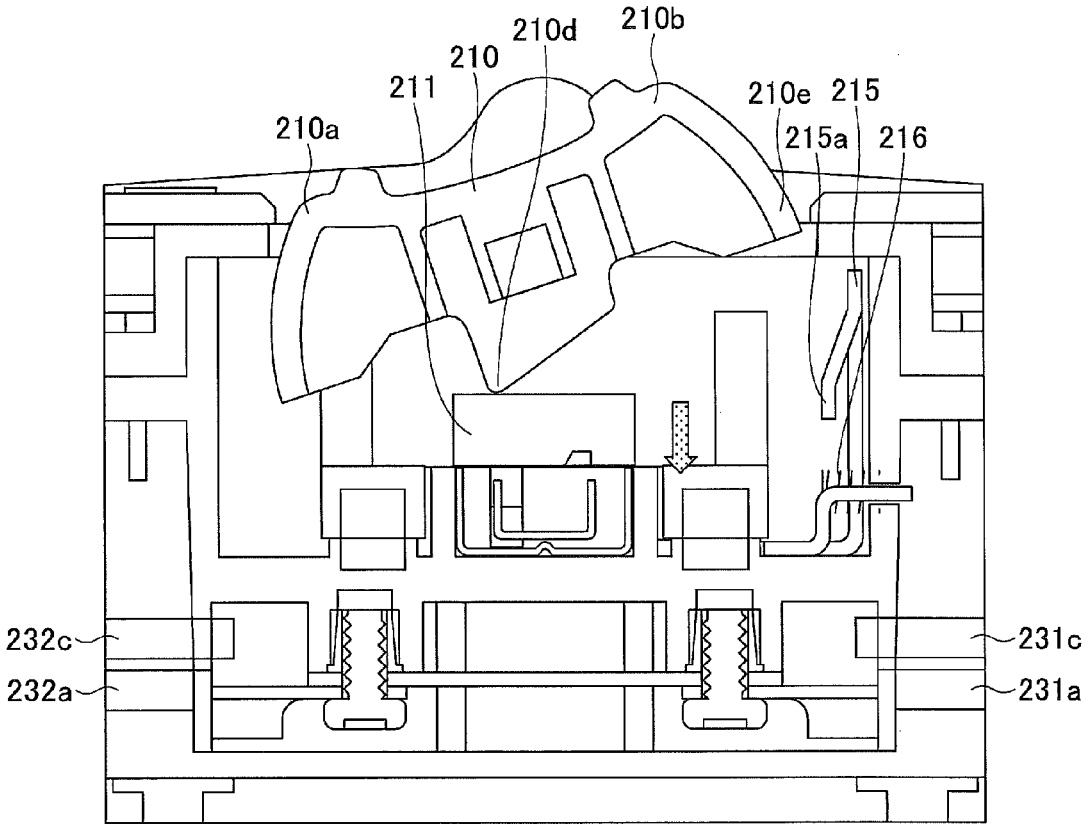
FIG. 31 is a cut-away side view (1) of a switch in an ON state according to the third embodiment.
Figure 32:
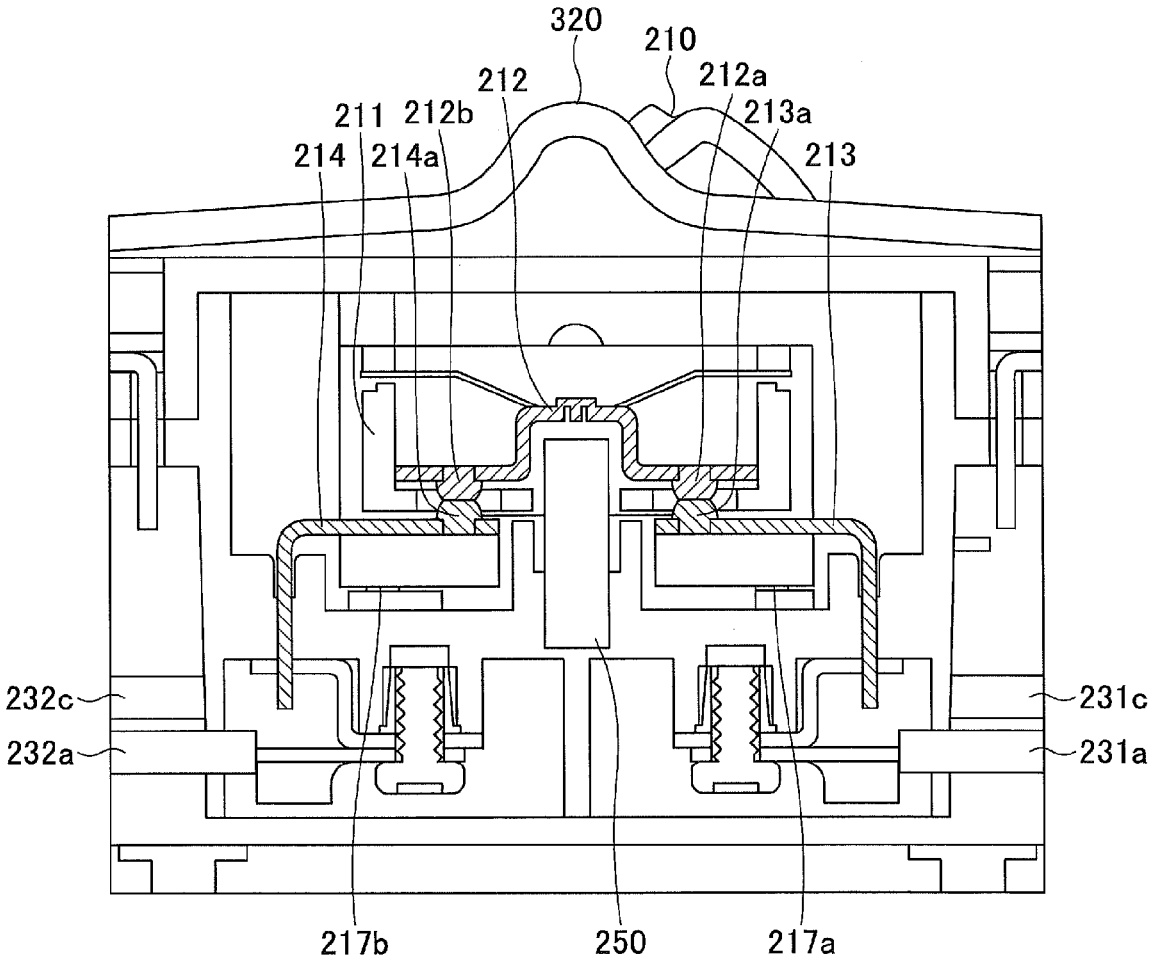
FIG. 32 is a cut-away side view (2) of a switch in an ON state according to the third embodiment.
Figure 33:
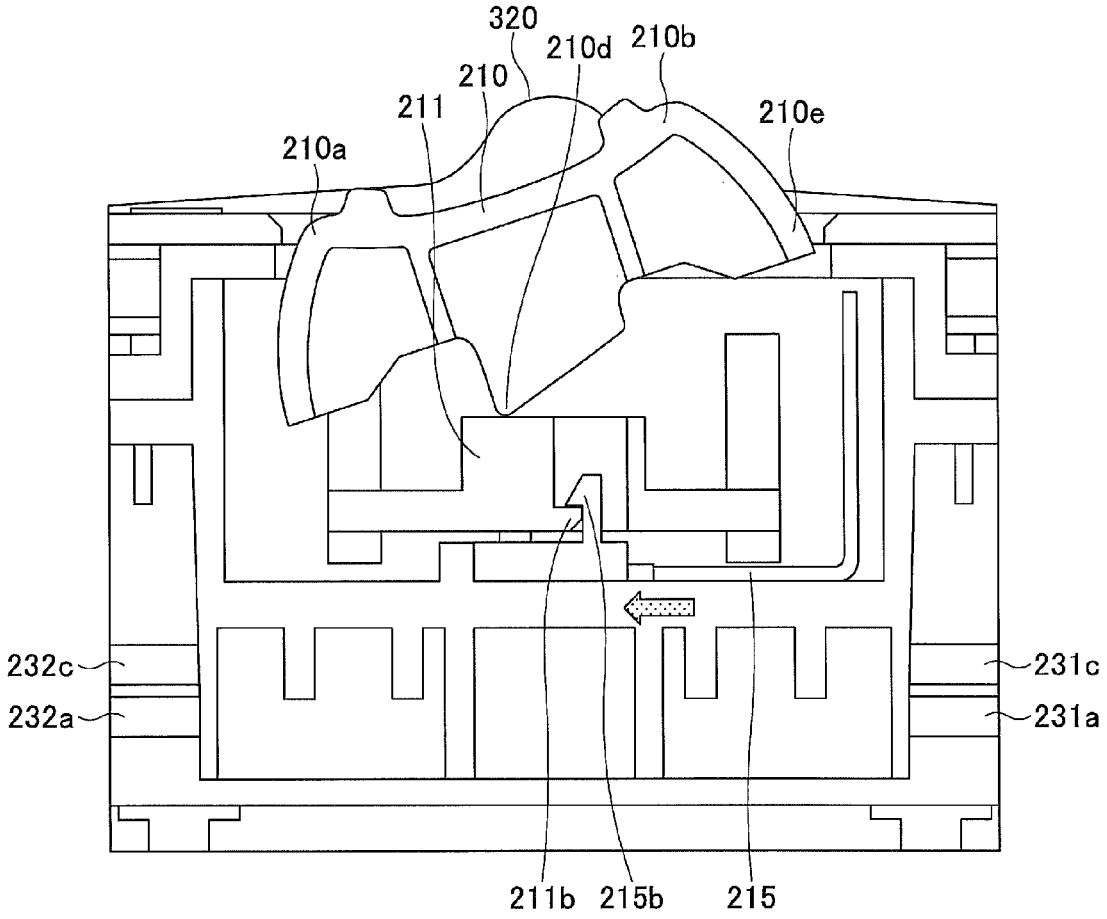
FIG. 33 is a cut-away side view (3) of a switch in an ON state according to the third embodiment.

First, the ON state is described. FIG. 30 is a cut-away side view of the switch in the OFF state, and FIG. 31 is a cut-away side view of a portion, where the operation part 210 is disposed, of the switch in the ON state. FIG. 32 is a cut-away side view of a portion of the switch in the ON state where the movable contact part 212 and the fixed contact parts 213 and 214 are disposed, and FIG. 33 is a cut-away side view of a portion of the switch in the ON state where the lock 215 is disposed.

In the switch of the present embodiment, the control button 211 is provided below the operation part 210 and is movable in the vertical direction in the figures. When the first end 210*a* of the operation part 210 is pressed, the operation part 210 rotates around an operation part rotating shaft and presses the control button 211. As a result, the control button 211 moves downward. In other words, when the first end 210*a* of the operation part 210 is pressed while the switch is in the OFF state as illustrated by FIG. 30, the switch changes to the ON state as illustrated by FIGS. 31 through 33.

The control button 211 supports the movable contact part 212. When the first end 210*a* of the operation part 210 is pressed while the switch is in the state illustrated by FIG. 30, the operation part 210 rotates around the operation part rotating shaft, and a control button pressing part 210*d* presses the control button 211 in a direction indicated by an arrow in FIG. 31. As a result, the control button 211 moves downward. When the control button 211 moves downward, the movable contact part 212 also moves downward, the movable contact 212*a* of the movable contact part 212 touches the fixed contact 213*a* of the fixed contact part 213, and similarly, the movable contact 212*b* touches the fixed contact 214*a*. As a result, the fixed contact part 213 and the fixed contact part 214 are electrically connected to each other via the movable contact part 212, and the switch becomes the ON state.

In the ON state, the positive (+) electric wire 231*a* of the power cable 231 and the positive (+) electric wire 232*a* of the power cable 232 are electrically connected to each other, the negative (−) electric wire 231*b* of the power cable 231 and the negative (−) electric wire 232*b* of the power cable 232 are electrically connected to each other, and power is supplied from the power cable 231 to the power cable 232.

Figure 34:
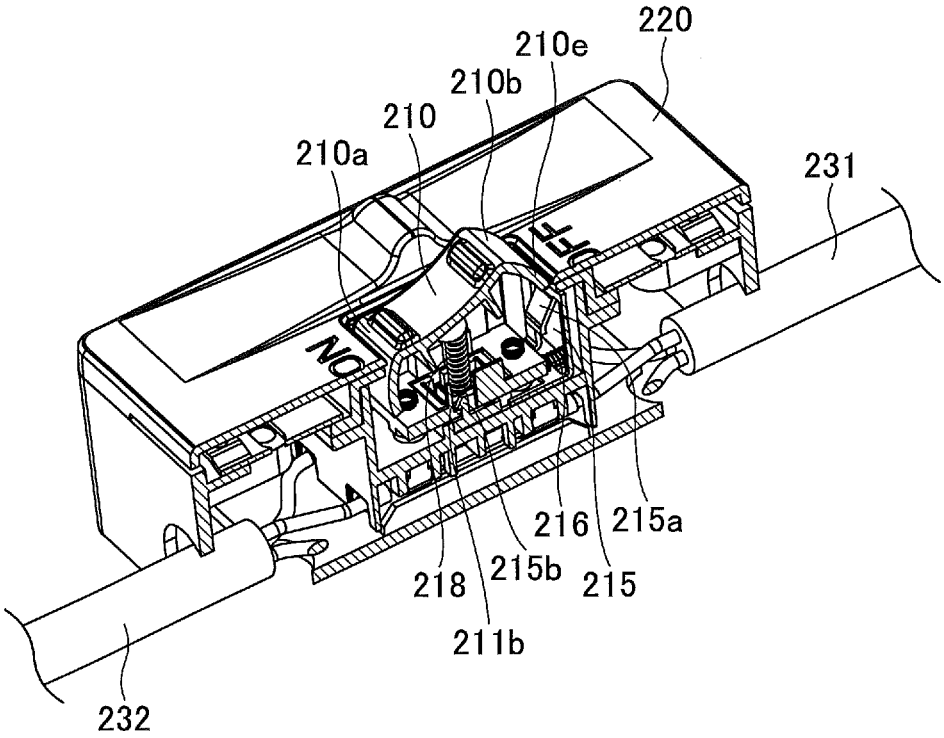
FIG. 34 is a drawing (1) illustrating a switch in an ON state according to the third embodiment.
Figure 35:
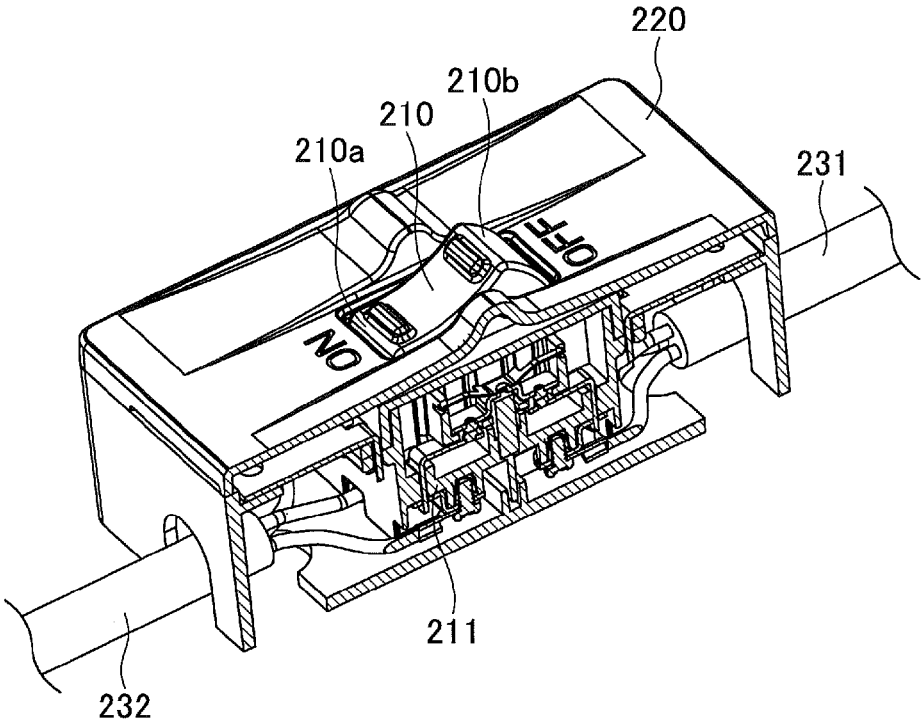
FIG. 35 is a drawing (2) illustrating a switch in an ON state according to the third embodiment.
Figure 36:
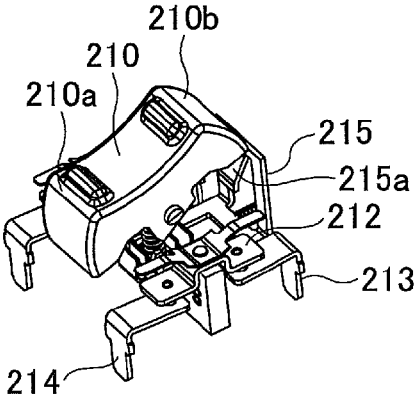
FIG. 36 is a perspective view of a portion, including an operation part, of a switch in an ON state according to the third embodiment.

The ON state of the switch of the present embodiment is described in more detail with reference to FIGS. 34 through 36. FIG. 34 is a perspective view of a cross section of the switch in the ON state, and FIG. 35 is a perspective view of a cross section of the switch in the ON state, which is different from FIG. 34. FIG. 36 is a perspective view of a portion of the switch including the operation part 210 in the ON state.

The switch of the present embodiment becomes the ON state illustrated by FIG. 31 through 33 when the first end 210*a* of the operation part 210 is pressed while the switch is in the OFF state illustrated by FIG. 30, and the ON state is maintained by a force of the operation part spring 218. In FIG. 34, for illustration purposes, the operation part spring 218 is illustrated as being in a straight shape. In practice, however, when the first end 210*a* of the operation part 210 is pressed, the operation part spring 218 is bent into a dog-leg shape and maintains the ON state.

When the first end 210*a* is pressed, a lock contact part 215*a* of the lock 215 and a side contact part 210*e* of the operation part 210 illustrated in FIG. 30 are separated from each other, the lock 215 is pressed by the restoring force of the lock spring 216 and moves in a direction of an arrow in FIG. 33, and a protrusion 215*b* at an end of the lock 215 engages with an L-shaped engaging part 211*b* of the control button 211. In the state illustrated by FIG. 33, the control button 211 is locked by the protrusion 215*b* engaging with the engaging part 211*b*. Therefore, even when the operation part 210 slightly rotates around the operation part rotating shaft, the control button 211 does not move upward in FIG. 33. Accordingly, the contact between the movable contact 212*a* and the fixed contact 213*a* and the contact between the movable contact 212*b* and the fixed contact 214*a* are maintained, and the ON state is maintained. The switch of the present embodiment also includes the return springs 217*a* and 217*b* connected to the control button 211. In the ON state, the return springs 217*a* and 217*b* are pressed and contracted by the control button 211.

Next, a state of the switch between the ON state and the OFF state is described with reference to FIG. 37.

Figure 37:
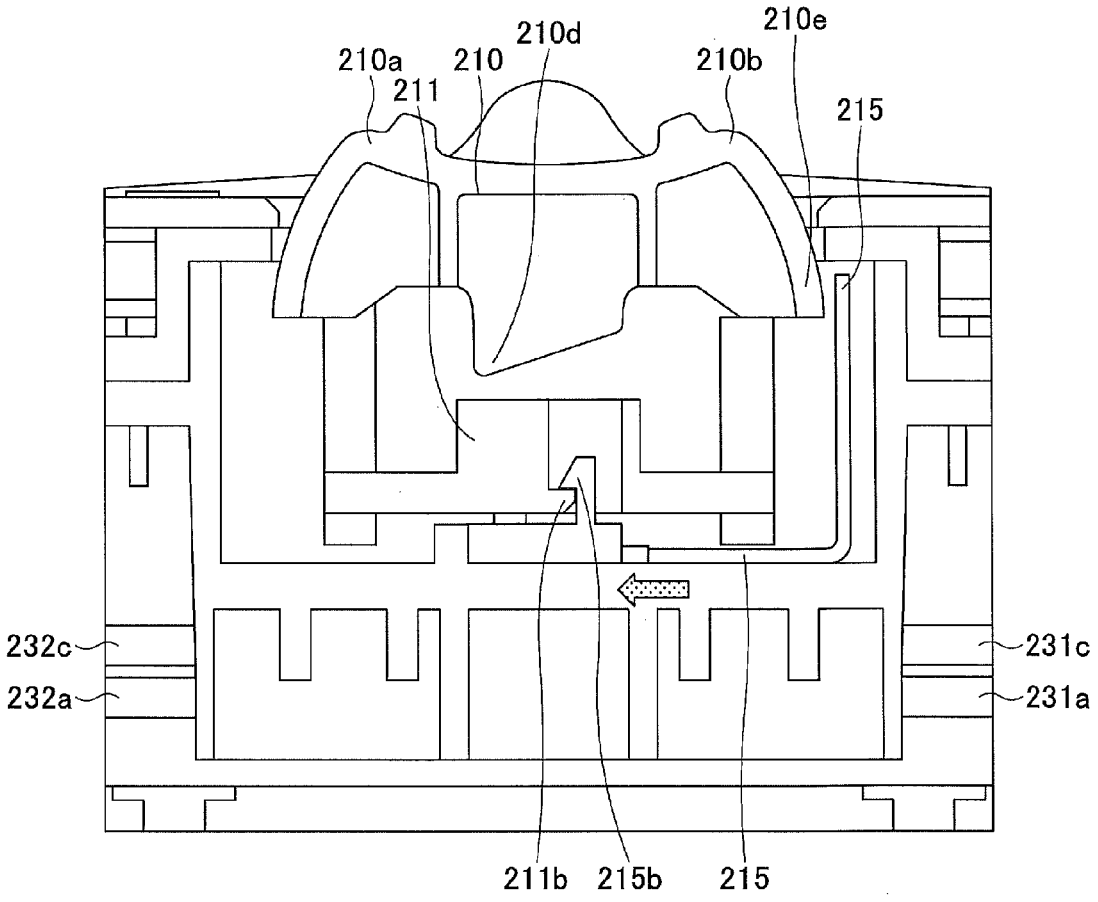
FIG. 37 is a cut-away side view of a switch changing from an ON state to an OFF state according to the third embodiment.

In the present embodiment, when the second end 210*b* of the operation part 210 is pressed while the switch is in the ON state illustrated by FIG. 31, the operation part 210 rotates around the operation part rotating shaft, and the switch changes into a transient state as illustrated by FIG. 37. In the transient state, the protrusion 215*b* of the lock 215 being biased to the left in FIG. 37 is still engaging with the engaging part 211*b* of the control button 211 although the control button pressing part 210*d* of the operation part 210 is not in contact with the control button 211, and therefore the control button 211 is held by the lock 215 and does not move upward. Accordingly, the contact between the movable contact 212*a* and the fixed contact 213*a* and the contact between the movable contact 212*b* and the fixed contact 214*a* are maintained, and the switch is maintained in the ON state. Also in the transient state, the side contact part 210*e* of the operation part 210 is not in contact with the lock contact part 215*a* of the lock 215, or the lock contact part 215 is not being pressed by the side contact part 210*e* of the operation part 210.

Figure 38:
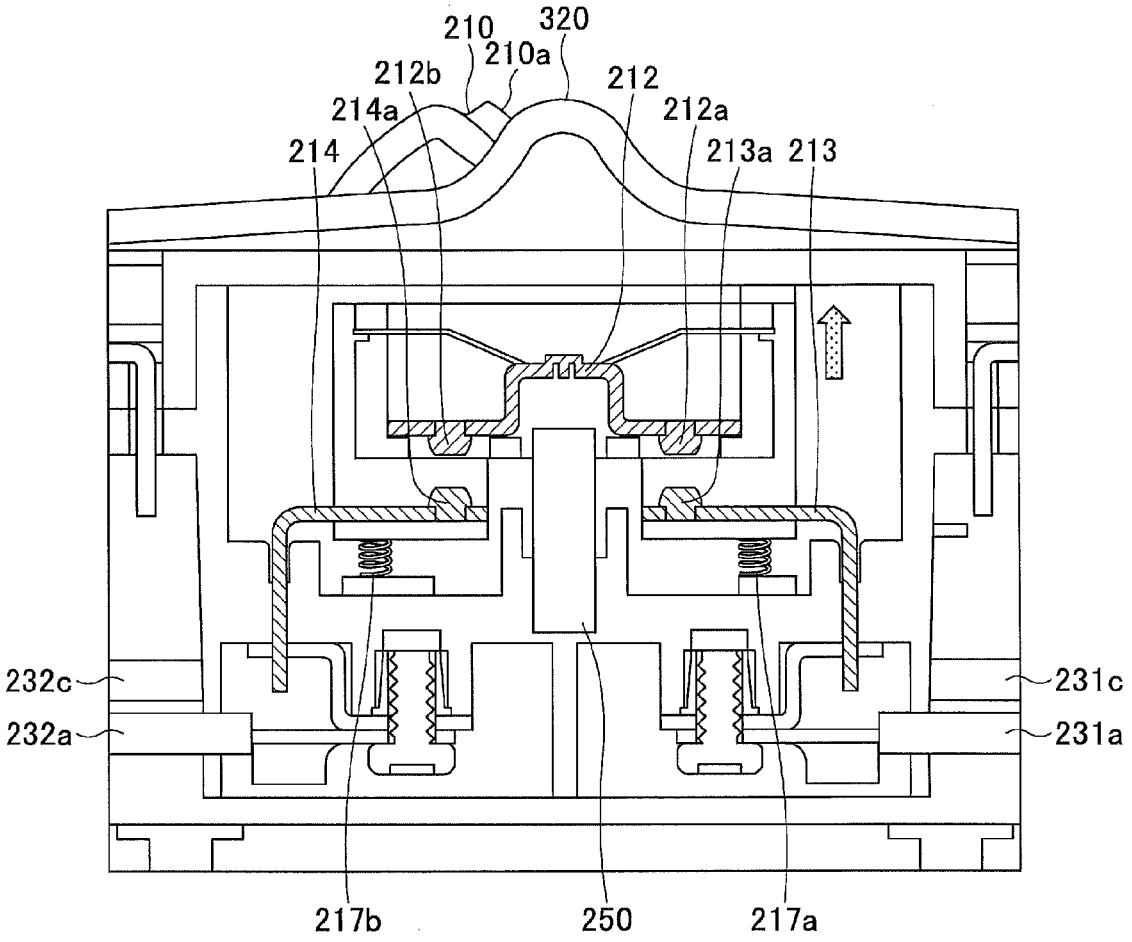
FIG. 38 is a cut-away side view (2) of a switch in an OFF state according to the third embodiment.
Figure 39:
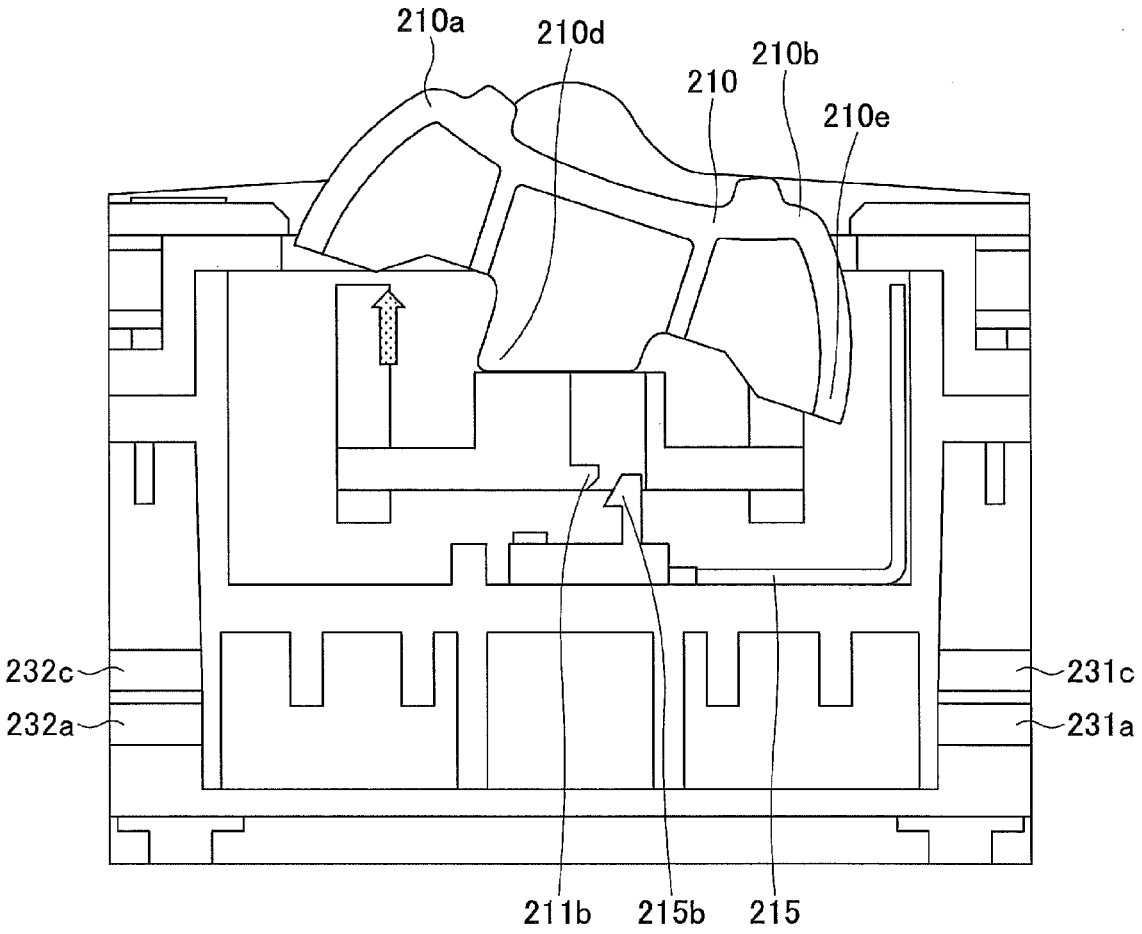
FIG. 39 is a cut-away side view (3) of a switch in an OFF state according to the third embodiment.
Figure 40:
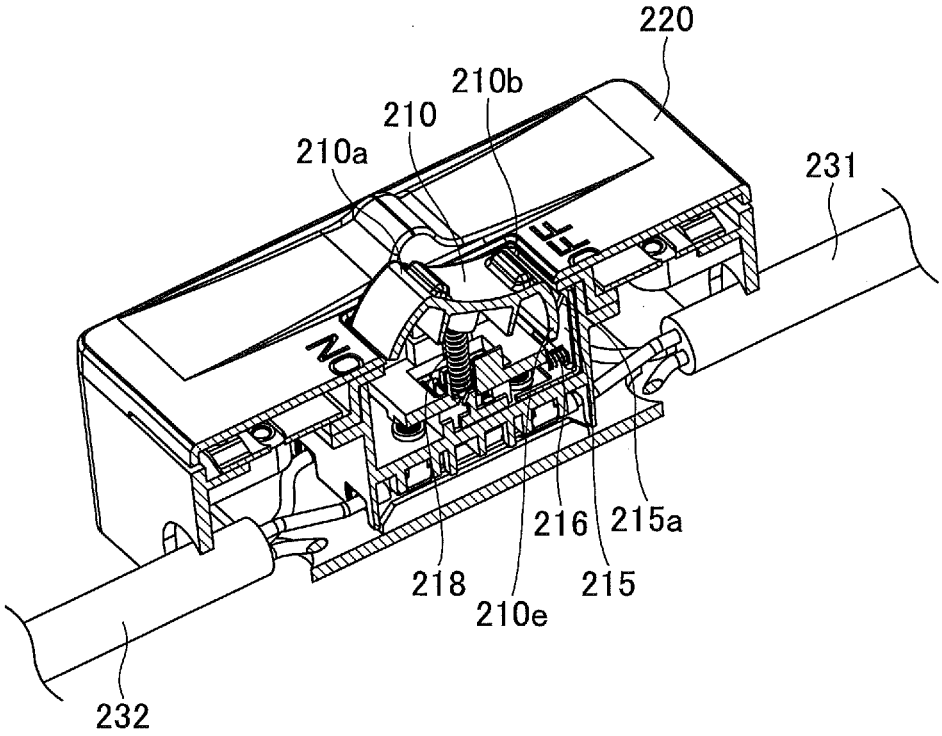
FIG. 40 is a drawing (1) illustrating a switch in an OFF state according to the third embodiment.
Figure 41:
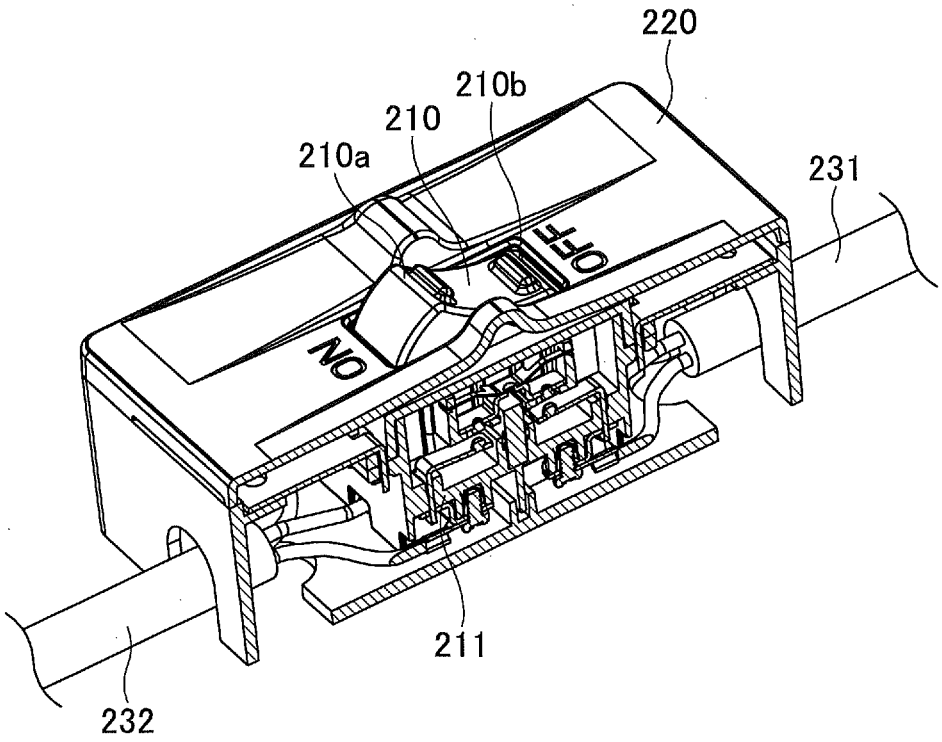
FIG. 41 is a drawing (2) illustrating a switch in an OFF state according to the third embodiment.
Figure 42:
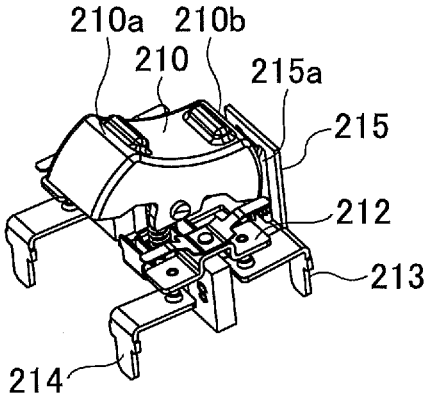
FIG. 42 is a perspective view of parts around an operation part of a switch in an OFF state according to the third embodiment.

Next, the OFF state is described with reference to FIG. 30 and FIGS. 38 through 42. FIG. 38 is a cut-away side view of a portion of the switch where the movable contact part 212 and the fixed contact parts 213 and 214 are disposed in the OFF state, and FIG. 39 is a cut-away side view of a portion of the switch where the lock 215 is disposed in the OFF state. FIG. 40 is a perspective view of a cross section of the switch in the OFF state, and FIG. 41 is a perspective view of a cross section, which is different from FIG. 40, of the switch in the OFF state. FIG. 42 is a perspective view of a portion of the switch including the operation part 210 in the OFF state.

The switch of the present embodiment becomes the OFF state when the second end 210*b* of the operation part 210 is pressed further from the position illustrated in FIG. 37. The OFF state is maintained by the force of the operation part spring 218. In FIG. 40, for illustration purposes, the operation part spring 218 is illustrated as being in a straight shape. In practice, however, when the second end 210*b* of the operation part 210 is pressed, the operation part spring 218 is bent into a dog-leg shape and maintains the OFF state.

When the second end 210*b* of the operation part 210 is pressed further from the position in the transient state illustrated by FIG. 37, the operation part 210 rotates further around the operation part rotating shaft. When the operation part 210 rotates, as illustrated by FIG. 30, the side contact part 210*e* of the operation part 210 touches the lock contact part 215*a* of the lock 215, and presses the lock contact part 215*a* to the right in FIG. 30 against the restoring force of the lock spring 216. As a result, the lock 215 moves to the right in FIG. 30, the protrusion 215*b* of the lock 215 moves away from the engaging part 211*b* of the control button 211 and the control button 211 is unlocked as illustrated in FIG. 39, and the control button 211 is raised by the restoring forces of the return springs 217*a* and 217*b* in a direction of an arrow in FIG. 39. Accordingly, the movable contact part 212 moves away from the fixed contact parts 213 and 214 in a direction of an arrow in FIG. 38, the movable contact 212*a* of the movable contact part 212 moves away from the fixed contact 213*a* of the fixed contact part 213, and the movable contact 212*b* of the movable contact part 212 moves away from the fixed contact 214*a* of the fixed contact part 214. The switch of the present embodiment is changed from the ON state to the OFF state by the restoring forces of the return springs 217*a* and 217*b*, and therefore can be turned off in a short period of time.

Because the switch of the present embodiment can be changed from the ON state to the OFF state in a very short period of time by the restoring forces of the return springs 217*a* and 217*b*, no arc is generated between the movable contact 212*a* and the fixed contact 213*a* and between the movable contact 212*b* and the fixed contact 214*a*, or an arc is generated only for a very short period of time. Accordingly, the switch is not damaged due to, for example, the melting of the movable contact part 212.

<Arc Extinguishing Function>

The switch of the present embodiment includes a function for instantly extinguishing arcs generated between the movable contact 212*a* and the fixed contact 213*a* and between the movable contact 212*b* and the fixed contact 214*a*.

The switch of the present embodiment includes the permanent magnet 250 below the movable contact part 212 and between the fixed contact part 213 and the fixed contact part 214. Arcs generated between the movable contact 212*a* and the fixed contact 213*a* and between the movable contact 212*b* and the fixed contact 214*a* are instantly extinguished by a magnetic field generated by the permanent magnet 250. In the switch of the present embodiment, the permanent magnet 250 is disposed below the movable contact part 212 and between the fixed contact part 213 and the fixed contact part 214 so that a magnetic field is efficiently applied between the movable contact 212*a* and the fixed contact 213*a* and between the movable contact 212*b* and the fixed contact 214*a*.

Preferred embodiments of the present invention are described above. However, the present invention is not limited to the specifically disclosed embodiments, and variations and modifications may be made without departing from the scope of the present invention.

The present application is based on and claims the benefit of priority of Japanese Patent Application No. 2012-222552 filed on Oct. 4, 2012, the entire contents of which are hereby incorporated herein by reference.

EXPLANATION OF REFERENCE NUMERALS

10 Operation part
10*a* First end
10*b* Second end
10*c* Operation part rotating shaft
10*d* Lock releasing part
11 Control button
11*a* Control button rotating shaft
11*b* Movable contact support
11*c* Engaging part
12 Movable contact part
12*a* Movable contact
13 Fixed contact part
13*a* Fixed contact
14 Operation part spring
15 Lock
15*a* First protrusion
15*b* Second protrusion
16 Lock spring
17 Return spring
20 Case
31 Power cable
31*a* Positive (+) electric wire
31*b* Negative (−) electric wire
31*c* GND electric wire
32 Power cable
32*a* Positive (+) electric wire
32*b* Negative (−) electric wire
32*c* GND electric wire
40 Substrate
50 Permanent magnet

The invention claimed is:

1. A switch, comprising:
a fixed contact part including a fixed contact;
a movable contact part including a movable contact;
a control button that supports the movable contact part and includes an engaging part;
an operation part including a first end and a second end; and
a lock including a first protrusion and a second protrusion, wherein the switch is configured such that
when the first end is pressed, the control button is pressed by the operation part, the movable contact contacts with the fixed contact, and the switch becomes an ON state;
while the movable contact and the fixed contact are in contact with each other, the first protrusion of the lock touches the engaging part of the control button to limit movement of the control button and maintain the ON state; and
when the second end is pressed, the operation part touches the second protrusion of the lock and moves the lock in such a direction that the first protrusion moves away from the engaging part, the movable contact moves away from the fixed contact, and the switch becomes an OFF state.

2. The switch as claimed in claim 1, wherein the switch is configured such that the first protrusion remains in contact with the engaging part and the ON state is maintained even when the operation part and the control button are separated from each other while the switch changes from the ON state to the OFF state.

3. The switch as claimed in claim 1, further comprising:
a return spring that contacts with the control button and has a restoring force in a direction to move the control button from the ON state to the OFF state.

4. The switch as claimed in claim 1, further comprising:
a lock spring having a restoring force in a direction to move the lock toward the engaging part of the control button.

5. The switch as claimed in claim 1, further comprising:
a case having an opening through which the operation part is exposed, and
a raised part provided on the case on each side of a central portion of the operation part.

6. A switch, comprising:
two fixed contact parts each of which includes a fixed contact;
a movable contact part including two movable contacts;
a control button including an engaging part;
an operation part including a first end, a second end, and a contacting part, and configured to be manually operated; and
a lock including a protrusion, wherein
the movable contact part contacts with the control button; and
the switch is configured such that
when the first end is pressed, the control button is pressed, each of the two movable contacts contacts a corresponding fixed contact, and the switch becomes an ON state,
while each of the movable contacts is in contact with the corresponding fixed contact, the protrusion touches the engaging part to maintain the ON state, and
when the second end is pressed, the lock is pressed and moved by the contacting part, the protrusion moves away from the engaging part, each of the movable contacts moves away from the corresponding fixed contact, and the switch becomes an OFF state.

7. The switch as claimed in claim 6, wherein the switch is configured such that the protrusion remains in contact with the engaging part and the ON state is maintained even when the operation part and the control button are separated from each other while the switch changes from the ON state to the OFF state.

8. The switch as claimed in claim 6, further comprising:
a return spring that is in contact with the control button and has a restoring force in a direction to move the control button from the ON state to the OFF state.

9. The switch as claimed in claim 6, further comprising:

a lock spring having a restoring force in a direction to move the lock toward the engaging part of the control button.

10. The switch as claimed in claim 6, further comprising:

a magnet that is disposed between the two fixed contacts and applies a magnetic field between the fixed contacts and the movable contacts.

11. The switch as claimed in claim 6, further comprising:

a case having an opening, wherein the operation part protrudes through the opening of the case; and a raised part is provided on the case on each side of a central portion of the operation part.

* * * * *